US011415310B2

(12) United States Patent
Harvey et al.

(10) Patent No.: US 11,415,310 B2
(45) Date of Patent: Aug. 16, 2022

(54) LIGHT INCLUDING A HEAT SINK AND LEDS COUPLED TO THE HEAT SINK AND LIGHT INTENSITY MANAGEMENT THEREOF

(71) Applicant: Milwaukee Electric Tool Corporation, Brookfield, WI (US)

(72) Inventors: Kyle Harvey, Wauwatosa, WI (US); Ross McIntyre, Milwaukee, WI (US); David Proeber, Milwaukee, WI (US); Jason Isaacs, Milwaukee, WI (US); Joshua Schermerhorn, Wauwatosa, WI (US); Brian Cornell, West Allis, WI (US)

(73) Assignee: MILWAUKEE ELECTRIC TOOL CORPORATION, Brookfield, WI (US)

( * ) Notice: Subject to any disclaimer, the term of this patent is extended or adjusted under 35 U.S.C. 154(b) by 0 days.

(21) Appl. No.: 16/815,176

(22) Filed: Mar. 11, 2020

(65) Prior Publication Data

US 2020/0208831 A1 Jul. 2, 2020

Related U.S. Application Data

(63) Continuation of application No. 16/290,252, filed on Mar. 1, 2019, now Pat. No. 10,627,100, which is a (Continued)

(51) Int. Cl.
*F21L 4/00* (2006.01)
*F21V 29/70* (2015.01)

(Continued)

(52) U.S. Cl.
CPC ..... *F21V 29/83* (2015.01); *F21L 4/00* (2013.01); *F21L 4/08* (2013.01); *F21L 14/00* (2013.01);

(Continued)

(58) Field of Classification Search
CPC .. F21L 4/00; F21V 29/70; F21V 29/71; F21V 29/713; F21V 29/717

(Continued)

(56) References Cited

U.S. PATENT DOCUMENTS 3,331,958 A 7/1967 Adler
4,032,771 A 6/1977 Ilzig (Continued)

FOREIGN PATENT DOCUMENTS

DE 202007005003 U1 7/2007
EP 0193756 9/1986

(Continued)

OTHER PUBLICATIONS

International Search Report and Written Opinion for Application No. PCT/US2016/016602 dated May 10, 2016 (13 pages).

(Continued)

*Primary Examiner* — Toan C Ly
(74) *Attorney, Agent, or Firm* — Michael Best & Friedrich LLP

(57) ABSTRACT

A light includes a housing having a lens, a bottom cover, and a middle cover positioned between the lens and the bottom cover. The lens, the bottom cover, and the middle cover cooperate to form a water-tight space. The light additionally includes a chimney having a hollow tube extending from a bottom of the housing to a top of the housing, a heat sink coupled to the chimney and positioned within the lens, and one or more LEDs coupled to the heat sink to emit light through the lens. The light also includes a circuit board positioned within the water-tight space and coupled to the one or more LEDs to control operation of the light.

7 Claims, 19 Drawing Sheets

Related U.S. Application Data continuation of application No. 16/056,602, filed on Aug. 7, 2018, now Pat. No. 10,386,057, which is a continuation of application No. 15/851,013, filed on Dec. 21, 2017, now Pat. No. 10,066,827, which is a continuation of application No. 15/015,794, filed on Feb. 4, 2016, now Pat. No. 9,851,088.

(60) Provisional application No. 62/265,935, filed on Dec. 10, 2015, provisional application No. 62/111,990, filed on Feb. 4, 2015.

(51) Int. Cl.

| | |
|---|---|
| ***F21V 29/83*** | (2015.01) |
| ***F21V 23/04*** | (2006.01) |
| ***F21L 14/00*** | (2006.01) |
| ***F21V 29/78*** | (2015.01) |
| ***F21L 4/08*** | (2006.01) |
| ***F21S 9/02*** | (2006.01) |
| ***F21V 23/06*** | (2006.01) |
| ***F21V 23/00*** | (2015.01) |
| *F21Y 115/10* | (2016.01) |
| *F21Y 101/00* | (2016.01) |
| *F21Y 107/00* | (2016.01) |

(52) U.S. Cl.

CPC ..... *F21S 9/02* (2013.01); *F21V 23/006* (2013.01); *F21V 23/0435* (2013.01); *F21V 23/06* (2013.01); *F21V 29/70* (2015.01); *F21V 29/78* (2015.01); *F21Y 2101/00* (2013.01); *F21Y 2107/00* (2016.08); *F21Y 2115/10* (2016.08)

(58) Field of Classification Search

USPC ..... 362/190

See application file for complete search history.

(56) References Cited

U.S. PATENT DOCUMENTS

| | | | |
|---|---|---|---|
| 4,228,489 | A | 10/1980 | Martin |
| 4,268,894 | A | 5/1981 | Bartunek et al. |
| 4,324,477 | A | 4/1982 | Miyazaki |
| 5,203,621 | A | 4/1993 | Weinmeister et al. |
| 5,207,747 | A | 5/1993 | Gordin et al. |
| 5,351,172 | A | 9/1994 | Attree et al. |
| 5,400,234 | A | 3/1995 | Yu |
| 5,428,520 | A | 6/1995 | Skeif |
| 5,630,660 | A | 5/1997 | Chen |
| 5,934,628 | A | 8/1999 | Bosnakovic |
| 5,964,524 | A | 10/1999 | Qian |
| 6,045,240 | A | 4/2000 | Hochstein |
| D428,176 | S | 7/2000 | Bamber et al. |
| 6,092,911 | A | 7/2000 | Baker, III et al. |
| 6,099,142 | A | 8/2000 | Liu |
| 6,149,283 | A | 11/2000 | Conway et al. |
| 6,183,114 | B1 | 2/2001 | Cook et al. |
| 6,213,626 | B1 | 4/2001 | Qian |
| 6,255,786 | B1 | 7/2001 | Yen |
| 6,265,969 | B1 | 7/2001 | Shih |
| D452,022 | S | 12/2001 | Osiecki et al. |
| 6,367,949 | B1 | 4/2002 | Pederson |
| 6,379,023 | B1 | 4/2002 | Passno |
| 6,425,678 | B1 | 7/2002 | Verdes et al. |
| 6,461,017 | B2 | 10/2002 | Selkee |
| 6,474,844 | B1 | 11/2002 | Ching |
| 6,554,459 | B2 | 4/2003 | Yu et al. |
| 6,637,904 | B2 | 10/2003 | Hernandez |
| 6,824,297 | B1 | 11/2004 | Lee |
| 6,845,279 | B1 | 1/2005 | Gilmore et al. |
| 6,854,862 | B1 | 2/2005 | Hopf |
| 6,857,756 | B2 | 2/2005 | Reiff et al. |
| 6,873,249 | B2 | 3/2005 | Chu |
| 6,877,881 | B2 | 4/2005 | Tsao |
| 6,899,441 | B2 | 5/2005 | Chen |
| D506,847 | S | 6/2005 | Hussaini et al. |
| 6,902,294 | B2 | 6/2005 | Wright |
| 6,926,428 | B1 | 8/2005 | Lee |
| 7,001,044 | B2 | 2/2006 | Leen |
| 7,001,047 | B2 | 2/2006 | Holder et al. |
| 7,011,280 | B2 | 3/2006 | Murray et al. |
| 7,063,444 | B2 | 6/2006 | Lee et al. |
| 7,073,926 | B1 | 7/2006 | Kremers et al. |
| D532,536 | S | 11/2006 | Krieger et al. |
| 7,152,997 | B1 | 12/2006 | Kovacik et al. |
| 7,153,004 | B2 | 12/2006 | Galli |
| 7,194,358 | B2 | 3/2007 | Callaghan |
| 7,195,377 | B2 | 3/2007 | Tsai |
| 7,224,271 | B2 | 5/2007 | Wang |
| D553,281 | S | 10/2007 | Rugendyke et al. |
| D553,771 | S | 10/2007 | Watson et al. |
| 7,278,761 | B2 | 10/2007 | Kuan |
| 7,350,940 | B2 | 4/2008 | Haugaard et al. |
| 7,364,320 | B2 | 4/2008 | Van Deursen et al. |
| 7,367,695 | B2 | 5/2008 | Shiau |
| 7,470,036 | B2 | 12/2008 | Deighton et al. |
| 7,484,858 | B2 | 2/2009 | Deighton et al. |
| 7,503,530 | B1 | 3/2009 | Brown |
| 7,566,151 | B2 | 7/2009 | Whelan et al. |
| 7,618,154 | B2 | 11/2009 | Rosiello |
| 7,638,970 | B1 | 12/2009 | Gebhard et al. |
| 7,670,034 | B2 | 3/2010 | Zhang et al. |
| 7,798,684 | B2 | 9/2010 | Boissevain |
| 7,828,465 | B2 | 11/2010 | Robarge et al. |
| 7,857,486 | B2 | 12/2010 | Long |
| 7,914,178 | B2 | 3/2011 | Xiang et al. |
| 7,914,182 | B2 | 3/2011 | Mrakovich et al. |
| 7,972,036 | B1 | 7/2011 | Schach et al. |
| D643,138 | S | 8/2011 | Kawase et al. |
| 7,988,335 | B2 | 8/2011 | Liu et al. |
| 7,990,062 | B2 | 8/2011 | Liu |
| 7,997,753 | B2 | 8/2011 | Walesa et al. |
| 8,007,128 | B2 | 8/2011 | Wu et al. |
| 8,007,145 | B2 | 8/2011 | Leen |
| 8,029,169 | B2 | 10/2011 | Liu |
| 8,047,481 | B2 | 11/2011 | Shen |
| 8,087,797 | B2 | 1/2012 | Pelletier et al. |
| 8,142,045 | B2 | 3/2012 | Peak |
| 8,167,466 | B2 | 5/2012 | Liu |
| 8,201,979 | B2 | 6/2012 | Deighton et al. |
| D665,521 | S | 8/2012 | Werner et al. |
| 8,235,552 | B1 | 8/2012 | Tsuge |
| 8,262,248 | B2 | 9/2012 | Wessel |
| 8,294,340 | B2 | 10/2012 | Yu et al. |
| 8,322,892 | B2 | 12/2012 | Scordino et al. |
| 8,328,398 | B2 | 12/2012 | Van Deursen |
| 8,330,337 | B2 | 12/2012 | Yu et al. |
| 8,360,607 | B2 | 1/2013 | Bretschnieder et al. |
| 8,366,290 | B2 | 2/2013 | Maglica |
| 8,403,522 | B2 | 3/2013 | Chang |
| 8,425,091 | B2 | 4/2013 | Chen |
| 8,439,531 | B2 | 5/2013 | Trott et al. |
| 8,465,178 | B2 | 6/2013 | Wilcox et al. |
| 8,485,691 | B2 | 7/2013 | Hamel et al. |
| 8,547,022 | B2 | 10/2013 | Summerford et al. |
| D695,434 | S | 12/2013 | Shen |
| 8,599,097 | B2 | 12/2013 | Intravatola |
| D698,471 | S | 1/2014 | Poon |
| D699,874 | S | 2/2014 | Chilton et al. |
| 8,651,438 | B2 | 2/2014 | Deighton et al. |
| 8,659,433 | B2 | 2/2014 | Petrou |
| 8,692,444 | B2 | 4/2014 | Patel et al. |
| 8,696,177 | B1 | 4/2014 | Frost |
| D705,467 | S | 5/2014 | Aglassinger |
| D708,376 | S | 7/2014 | Crowe et al. |
| 8,801,226 | B2 | 8/2014 | Moore |
| 8,851,699 | B2 | 10/2014 | McMillan |
| 8,858,016 | B2 | 10/2014 | Strelchuk |
| 8,858,026 | B2 | 10/2014 | Lee et al. |
| 8,939,602 | B2 | 1/2015 | Wessel |
| 8,979,331 | B2 | 3/2015 | Lee |

(56) References Cited

U.S. PATENT DOCUMENTS

| | | | |
|---|---|---|---|
| D726,354 | S | 4/2015 | Davies |
| D728,402 | S | 5/2015 | Case |
| 9,068,736 | B2 | 6/2015 | Lee et al. |
| D747,263 | S | 1/2016 | Lafferty |
| 2002/0136005 | A1 | 9/2002 | Lee |
| 2002/0167814 | A1 | 11/2002 | Ching |
| 2003/0090234 | A1 | 5/2003 | Glasgow |
| 2003/0090904 | A1 | 5/2003 | Ching |
| 2003/0137847 | A1 | 7/2003 | Cooper |
| 2003/0174503 | A1 | 9/2003 | Yueh |
| 2006/0007682 | A1 | 1/2006 | Reiff et al. |
| 2006/0067077 | A1 | 3/2006 | Kumthampinij et al. |
| 2006/0146550 | A1 | 7/2006 | Simpson et al. |
| 2006/0250269 | A1 | 11/2006 | Wang et al. |
| 2006/0279948 | A1 | 12/2006 | Tsai |
| 2006/0285323 | A1 | 12/2006 | Fowler |
| 2007/0211470 | A1 | 9/2007 | Huang |
| 2007/0297167 | A1 | 12/2007 | Greenhoe |
| 2008/0112160 | A1 | 5/2008 | Robinson et al. |
| 2008/0112170 | A1 | 5/2008 | Trott et al. |
| 2008/0158887 | A1 | 7/2008 | Zhu et al. |
| 2008/0165537 | A1 | 7/2008 | Shiau |
| 2008/0198588 | A1 | 8/2008 | O'Hern |
| 2008/0253125 | A1 | 10/2008 | Kang et al. |
| 2008/0302933 | A1 | 12/2008 | Cardellini |
| 2009/0021944 | A1 | 1/2009 | Lee et al. |
| 2009/0080205 | A1 | 3/2009 | Chang |
| 2009/0134191 | A1 | 5/2009 | Phillips |
| 2009/0135594 | A1 | 5/2009 | Yu et al. |
| 2009/0303717 | A1 | 12/2009 | Long |
| 2009/0323348 | A1 | 12/2009 | Shuai et al. |
| 2010/0027260 | A1 | 2/2010 | Liu |
| 2010/0027269 | A1 | 2/2010 | Lo et al. |
| 2010/0072897 | A1 | 3/2010 | Zheng |
| 2010/0080005 | A1 | 4/2010 | Gattar |
| 2010/0091495 | A1 | 4/2010 | Patrick |
| 2010/0142213 | A1 | 6/2010 | Bigge et al. |
| 2010/0315824 | A1 | 12/2010 | Chang |
| 2010/0328951 | A1 | 12/2010 | Boissevain |
| 2011/0031887 | A1 | 2/2011 | Stoll et al. |
| 2011/0038144 | A1 | 2/2011 | Chang |
| 2011/0050070 | A1 | 3/2011 | Pickard |
| 2011/0058367 | A1 | 3/2011 | Shiau et al. |
| 2011/0075404 | A1 | 3/2011 | Mien et al. |
| 2011/0121727 | A1 | 5/2011 | Sharrah et al. |
| 2011/0228524 | A1 | 9/2011 | Greer |
| 2011/0286216 | A1 | 11/2011 | Araman |
| 2011/0317420 | A1 | 12/2011 | Jeon et al. |
| 2012/0026729 | A1 | 2/2012 | Sanchez et al. |
| 2012/0033400 | A1 | 2/2012 | Remus et al. |
| 2012/0033429 | A1 | 2/2012 | Van De Ven |
| 2012/0044707 | A1 | 2/2012 | Breidenassel |
| 2012/0048511 | A1 | 3/2012 | Moshtag |
| 2012/0049717 | A1 | 3/2012 | Lu |
| 2012/0057351 | A1 | 3/2012 | Wilcox et al. |
| 2012/0080944 | A1* | 4/2012 | Recker ..... H05B 47/105 307/25 |
| 2012/0087118 | A1 | 4/2012 | Bailet et al. |
| 2012/0087125 | A1 | 4/2012 | Liu |
| 2012/0098437 | A1 | 4/2012 | Smed |
| 2012/0120674 | A1 | 5/2012 | Jonker |
| 2012/0140455 | A1 | 6/2012 | Chang |
| 2012/0155104 | A1 | 6/2012 | Jonker |
| 2012/0212963 | A1 | 8/2012 | Jigamian |
| 2012/0234519 | A1 | 9/2012 | Lee |
| 2012/0236551 | A1 | 9/2012 | Sharrah et al. |
| 2012/0247735 | A1 | 10/2012 | Ito et al. |
| 2012/0262917 | A1 | 10/2012 | Courcelle |
| 2012/0300487 | A1 | 11/2012 | Jonker |
| 2013/0032323 | A1 | 2/2013 | Hsu |
| 2013/0058078 | A1 | 3/2013 | Meng |
| 2013/0063051 | A1 | 3/2013 | Sterling et al. |
| 2013/0077296 | A1 | 3/2013 | Goeckel et al. |
| 2013/0128565 | A1 | 5/2013 | Cugini et al. |
| 2013/0176713 | A1 | 7/2013 | Deighton et al. |
| 2013/0187785 | A1 | 7/2013 | McIntosh et al. |
| 2013/0258645 | A1 | 10/2013 | Weber et al. |
| 2013/0265780 | A1 | 10/2013 | Choksi |
| 2013/0322073 | A1 | 12/2013 | Hamm et al. |
| 2014/0140050 | A1 | 5/2014 | Wong et al. |
| 2014/0192543 | A1 | 7/2014 | Deighton et al. |
| 2014/0218936 | A1 | 8/2014 | Mahling et al. |
| 2014/0268775 | A1 | 9/2014 | Kennemer et al. |
| 2014/0301066 | A1 | 10/2014 | Inskeep |
| 2014/0307443 | A1 | 10/2014 | Clifford et al. |
| 2014/0350716 | A1 | 11/2014 | Fly |
| 2014/0376216 | A1 | 12/2014 | McLoughlin et al. |
| 2015/0023771 | A1 | 1/2015 | Carr et al. |
| 2015/0233569 | A1 | 8/2015 | Xue et al. |
| 2015/0233571 | A1 | 8/2015 | Inan et al. |
| 2016/0123571 | A1 | 5/2016 | Chen et al. |
| 2016/0165701 | A1 | 6/2016 | Smith |
| 2016/0348879 | A1 | 12/2016 | Young et al. |

FOREIGN PATENT DOCUMENTS

| | | |
|---|---|---|
| EP | 1205428 | 5/2002 |
| EP | 2436641 | 4/2012 |
| GB | 2424694 | 10/2006 |
| KR | 100827374 B1 | 5/2008 |
| KR | 20100116933 | 11/2010 |
| WO | 2002044503 | 6/2002 |
| WO | 2014083117 | 6/2014 |
| WO | 2014207595 | 12/2014 |

OTHER PUBLICATIONS

European Examination Report, Appl. No. EP 16708244.5, dated Jun. 15, 2018.

European Patent Office Extended Search Report for Application No. 19199968.9 dated Nov. 15, 2019 (8 pages).

European Patent Office Action for Application 19199968.9 dated Nov. 9, 2021 (6 pages).

* cited by examiner

LIGHT INCLUDING A HEAT SINK AND LEDS COUPLED TO THE HEAT SINK AND LIGHT INTENSITY MANAGEMENT THEREOF

RELATED APPLICATIONS

This application is a continuation of U.S. patent application Ser. No. 16/290,252, filed Mar. 1, 2019, now U.S. Pat. No. 10,627,100, which is a continuation of U.S. patent application Ser. No. 16/056,602, filed Aug. 7, 2018, now U.S. Pat. No. 10,386,057, which is a continuation of U.S. patent application Ser. No. 15/851,013, filed Dec. 21, 2017, now U.S. Pat. No. 10,066,827, which is a continuation of U.S. patent application Ser. No. 15/015,794, filed Feb. 4, 2016, now U.S. Pat. No. 9,851,088, which claims priority to U.S. Provisional Patent Application No. 62/111,990, filed on Feb. 4, 2015, and to U.S. Provisional Patent Application No. 62/265,935, filed on Dec. 10, 2015, the entire contents of all of which are incorporated herein by reference.

BACKGROUND

The invention relates to a portable light and more particularly to portable lights that include LEDs.

SUMMARY

In one construction, the light includes a plurality of LEDs that operate under either an AC or DC power supply. A chimney extends through the light and operates to enhance the cooling of the LEDs.

In another construction, a light includes a housing defining a bottom end and a top end, a heat sink disposed within the housing and including a central body that defines a central aperture, and a plurality of arms coupled to the central body and extending outward from the central body, each of the arms including a light receiving surface. A plurality of LEDs is coupled to each of the light receiving surfaces and a hollow tube extends from the bottom of the housing and is coupled to the heat sink to define a cooling air passage that passes through the hollow tube and the central aperture to direct cooling air from the bottom of the housing to the top of the housing.

In another construction, a light includes a housing, a heat sink disposed within the housing, a plurality of LEDs coupled to the heat sink and operable in response to a supply of power, and a first power supply including two power tool battery packs selectively coupled to the housing. A second power supply is arranged to receive AC power from an external source, and a power control circuit is operable to detect the level of charge in each of the power tool battery packs and to deliver power to the LEDs sequentially from the battery packs beginning with the battery pack having the lowest state of charge.

In still another construction, a light includes a housing defining a bottom end and a top end, and a heat sink disposed within the housing and including a central body that defines a central aperture and a plurality of external apertures, the central aperture extending along a central axis of the light and each of the external apertures extending along external axes that are parallel to and offset from the central axis. A plurality of arms is coupled to the central body and extends outward from the central body. Each of the arms includes a light receiving surface and a plurality of fins that extend from the light receiving surface toward the central axis. A plurality of LEDs is coupled to each of the light receiving surfaces, and a cooling air flow path extends from the bottom of the housing through the heat sink aperture to direct cooling air from the bottom of the housing to the top of the housing.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

DETAILED DESCRIPTION

Figure 1:
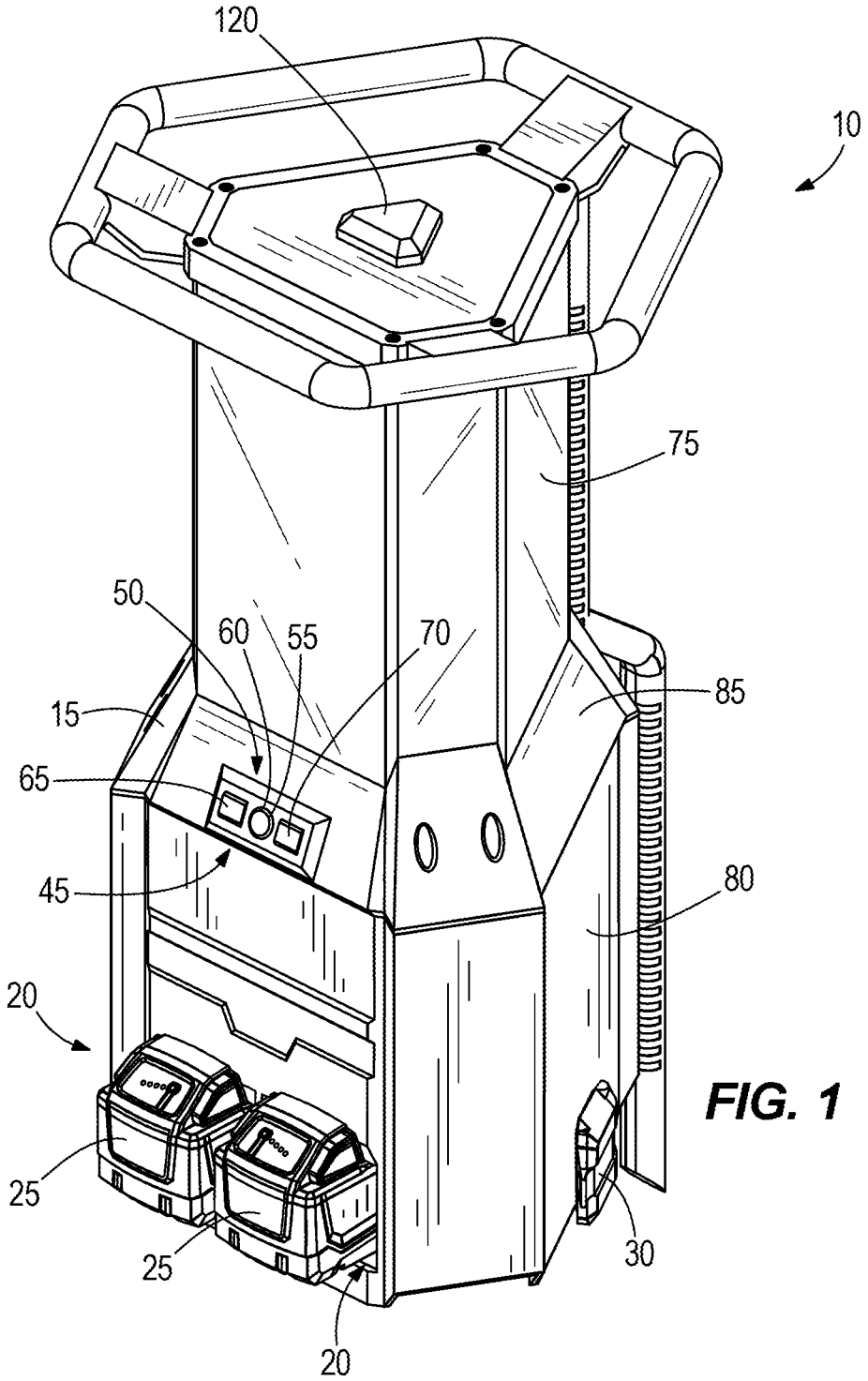
FIG. 1 is a perspective view of a light.

FIG. 1 illustrates a portable light 10 that is well-suited for use in areas where conventional lighting may not be available or may be inadequate. The illustrated light 10 includes a housing 15 that defines two battery ports 20 arranged to receive battery packs 25 to power the light 10. In preferred constructions, the battery packs 25 are power tool battery packs 25 that are operable at 18 volts or higher. In other constructions, other battery packs 25 may be used and more than two or a single battery pack 25 may be employed. In preferred constructions, the light 10 uses open link protocol and controls the battery packs 25 so that they transmit information sequentially and so that their messages do not overlap.

The housing 15 contains the electrical components of the area light 10. Specifically, the housing 15 includes power inputs 30 and power outlets 35 (shown in FIG. 4). The power inlets 30 connect the area light 10 to an external AC power source to power the area light 10. The power outlet 35 connects the area light 10 to another device to power that device. For example, in some embodiments, the power outlets can connect to another light so that a series of area lights 10 can be daisy-chained together. In other embodiments, the power outlet 35 can connect to a power tool to power the power tool. The housing 15 also supports charging circuits 40. The charging circuit 40 electrically couples the power inlet 30 to the battery pack 25 to charge the battery pack 25. The charging circuits 40 are accessible from the exterior of the housing 15 for inserting and removing the battery packs 25. In some embodiments, the battery packs 25 may be internal or permanently fixed to the area light 10 but are preferably removable power tool battery packs 25.

The illustrated housing 15 further includes a control panel 45 and a display panel 50 for controlling the operation of the area light 10 and displaying information relevant to the operation of the light 10 including various operating parameters or conditions of the light 10. The control panel 45 includes, among other things, a power button 55, a light intensity control 60, a light intensity indicator 65, and a power source indicator 70. The light intensity control 60 allows a use to increase or decrease the intensity of the light 10. There can be three intensity settings when the area light 10 is using DC power and six intensity settings when the area light 10 is using AC power. The light intensity indicator 65 may include a plurality of indicator bars that depict the level of intensity that the light 10 is supplying. Additionally the indicator bars may appear one color when the area light 10 is using DC power and a different color when the area light 10 is using AC power. The power source indicator 70 may include a second set of indicator bars that depict the amount of power (i.e., the state of charge) remaining in the battery packs 25. The panel 50 may also include an indicator that indicates what operating mode the light is in or other features and parameters of the light 10.

In some arrangements, the light 10 is operable remotely using any suitable communication scheme (e.g., Bluetooth, ONE-KEY etc.). In one construction, ONE-KEY can be used to remotely control the light 10. In these constructions, the panel 45, 50 may include an indicator that operates to notify a user when ONE-KEY is being used to control the light 10. In addition, there may be a control that locks the light 10 from being able to be controlled by a ONE-KEY device. The lock-out could be permanent or it could be for a fixed and predetermined period of time.

ONE-KEY includes an application for use on mobile devices such as smartphones and tablets. The ONE-KEY application could include a battery charge indicator and a status indicator (e.g., charging, waiting to charge, fully charged, etc.). In one construction, a desired run time can be selected (either at the control panel 45 or in the ONE-KEY application), and the light 10 computes a light intensity to achieve that run time based on the current state of charge of the battery packs 25, and the light output is set to that level of intensity.

In addition, the ONE-KEY application may allow the user to control what is done in response to a loss of DC (battery) power. For example, the light 10 could turn off, flash, run for a limited additional time period, etc. In one embodiment the light 10 is configured to adjust its brightness lower based on the proximity of the device that is using the ONE-KEY application to control the light 10.

In operation, if both the battery pack 25 and an AC power source are connected to the area light 10, the AC power source will charge the battery pack 25 and power the area light 10. If multiple battery packs 25 are inserted into the battery ports 20 (thereby connecting to charging circuits) during this time, the AC power will be used to charge one battery pack 25 at a time until all of the battery packs 25 are charged. When the AC power source becomes disconnected from the area light 10, the battery pack 25 (if sufficiently charged) will automatically begin powering the area light 10.

Although multiple battery packs 25 can be inserted into the battery ports 20 at a given time, the illustrated area light 10 only utilizes one battery pack 25 at a time. The area light 10 will utilize one battery pack 25 until that battery pack 25 has been fully drained of power. Then, the next battery pack 25 will begin powering the area light 10. In other words, the area light 10 is configured to utilize the battery packs 25 sequentially rather than in parallel.

When only a single battery pack 25 is inserted into the battery port 20 and thereby connected to the charging circuit 40, the area light 10 will engage in a power saving mode. During the power saving mode, the area light 10 will prolong the battery life by automatically decreasing the light intensity when the charge of the battery pack 25 falls below a certain level. When two or more battery packs 25 are inserted into the battery port 20, the area light 10 will continue to operate at the specified intensity level until each battery pack 25 is drained. When only one battery pack 25 remains un-drained, the area light 10 will go back into the power saving mode, reducing the intensity of the light in order to extend the battery life of the remaining battery pack 25.

Thus, the light 10 can be powered by DC current provided by the battery packs 25 or AC power provided by a conventional AC power source. When the light 10 is powered by DC from the battery packs 25, the light 10 first takes power from the battery pack 25 that has the lower state of charge to preserve the charge of the more highly charged battery pack 25. The battery packs 25 are then discharged in sequence and not in parallel. Of course, other arrangements or operating modes may vary the discharge arrangement of the battery packs 25.

Figure 5:
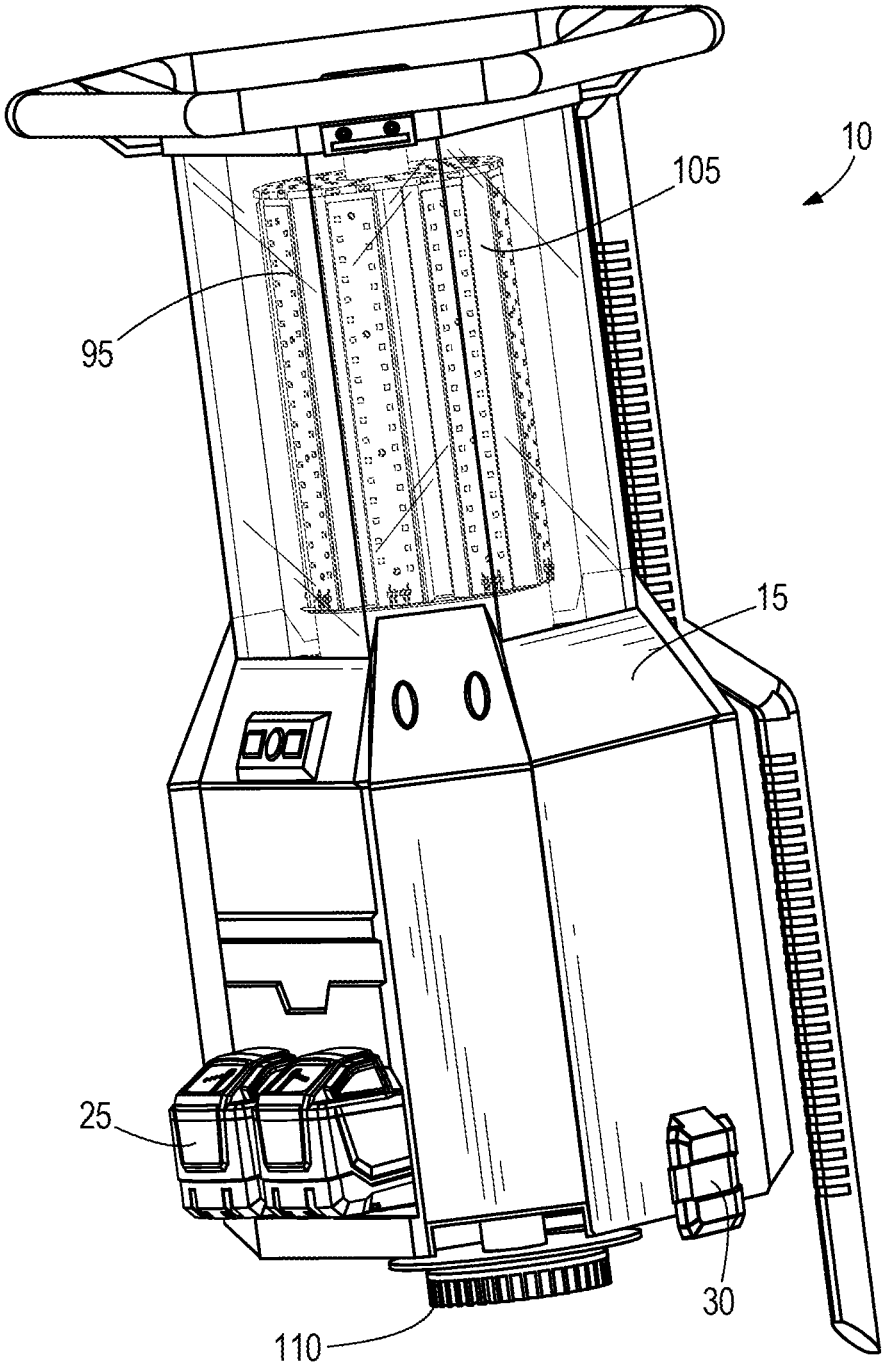
FIG. 5 is a perspective view of the light of FIG. 1.

With reference to FIG. 5, an upper portion 75 of the housing 15 operates to enclose the top portion of the light 10 and operate as a lens or diffuser to improve the quality of the light emitted by the light 10. A bottom cover 80, illustrated in FIG. 3 and a middle cover 85, illustrated in FIG. 2 cooperate with the upper portion 75 of the housing 15 to substantially enclose a water-tight space within the light 10.

Figure 2:
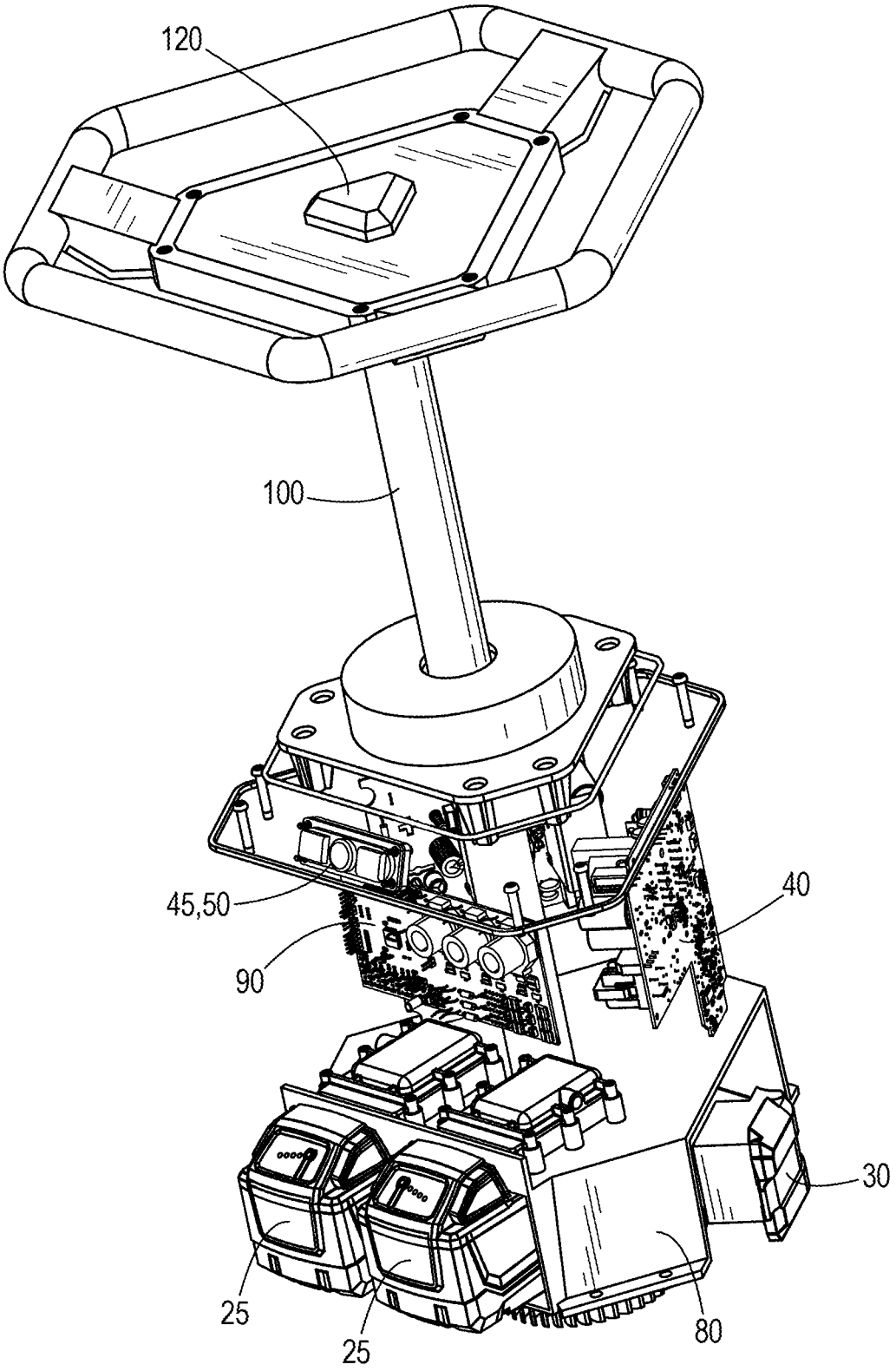
FIG. 2 is a perspective view of the light of FIG. 1 with the external covers removed.
Figure 3:
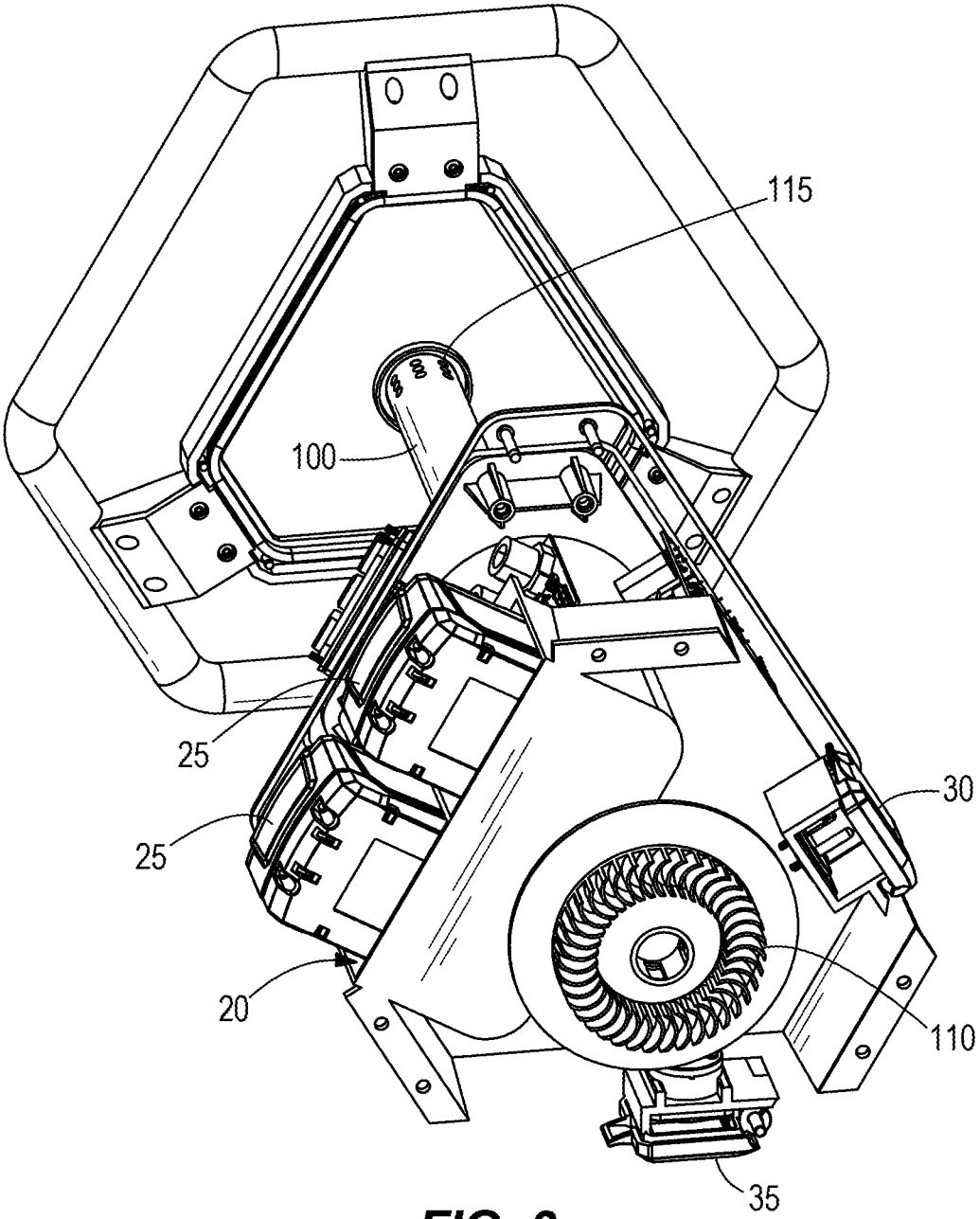
FIG. 3 is a bottom perspective view of the light arranged as shown in FIG. 2.

As illustrated in FIG. 2, the light 10 includes a plurality of printed circuit boards 90 that control the flow of power (including the charging circuit) and control the operation of the light 10. The circuit boards 90 are positioned within the water-tight space to protect the electronics from moisture.

Figure 6:
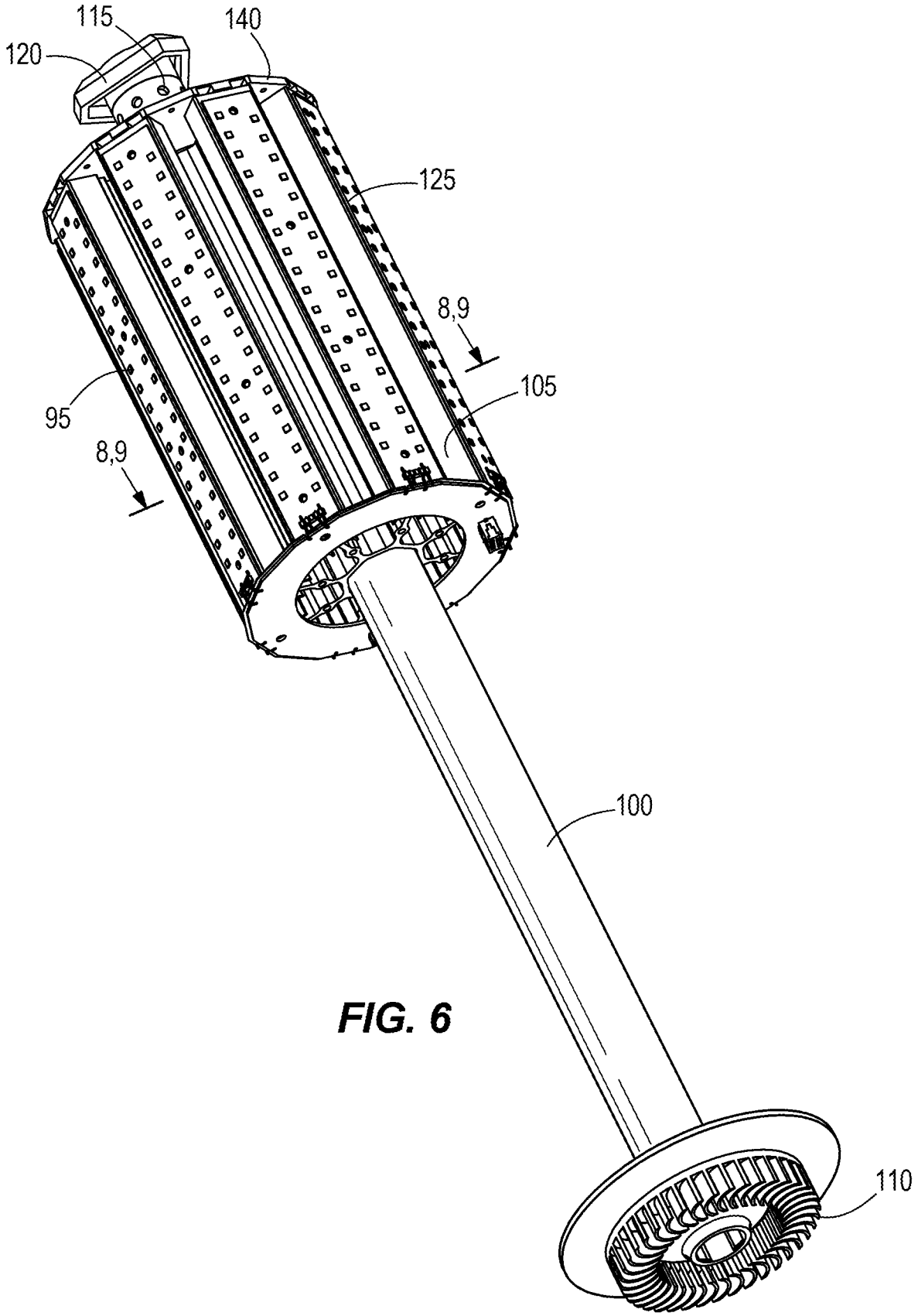
FIG. 6 is a perspective view of a chimney and light support member of the light of FIG. 1.
Figure 7:
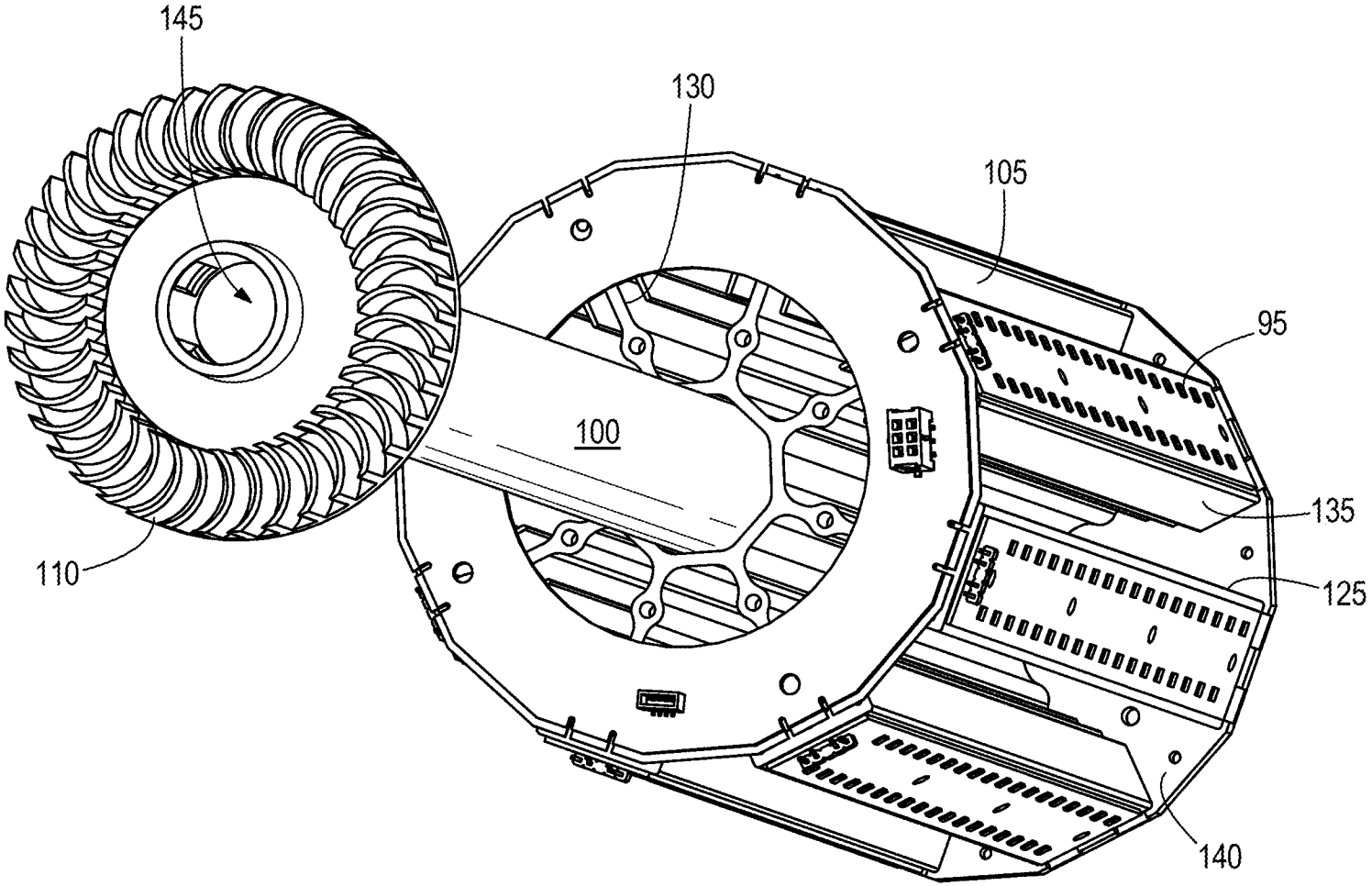
FIG. 7 is a bottom perspective view of the chimney and light support member of the light of FIG. 1.

With reference to FIG. 5, the light 10 includes a plurality of LEDs 95 that are positioned inside of the housing 15 and are operable to emit light (e.g., 10 k lumens or more) as desired. In order to dissipate heat, the light 10 includes a tube or chimney 100 and light support member or heat sink 105 as are best illustrated in FIG. 6. The chimney 100 includes a substantially hollow tube that extends from the bottom of the light 10 to the top of the light 10. Seals are formed between the chimney 100 and the housings 15 to maintain the substantially water-tight space.

Figure 4:
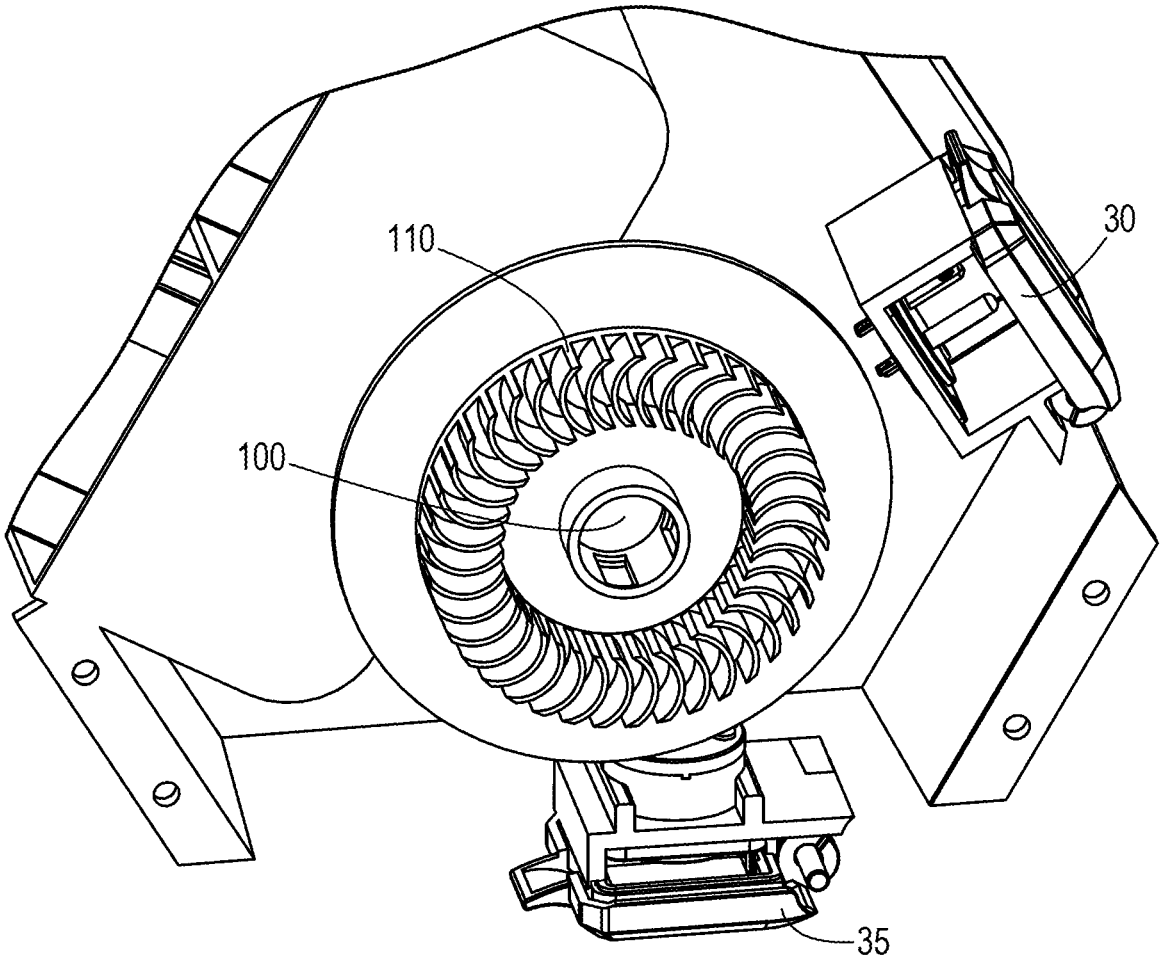
FIG. 4 is an enlarged view of the bottom of the light of FIG. 1.

A finned inlet member 110, illustrated in FIG. 4, is attached to the bottom of the chimney 100 or housing 15 and operates to guide cooling air into the chimney 100. A seal between the finned member 110, the chimney 100, and the housing 15 inhibits access to the chimney 100 by a user and/or debris entrance into the chimney 100. The top portion of the chimney 100 includes a plurality of apertures 115 that facilitate the escape of hot air from the chimney 100. A triangular cover member 120 engages the top of the chimney 100 to force the air out of the apertures 115 and also to inhibit access to the chimney 100 by a user or unwanted debris or water.

Figure 10:
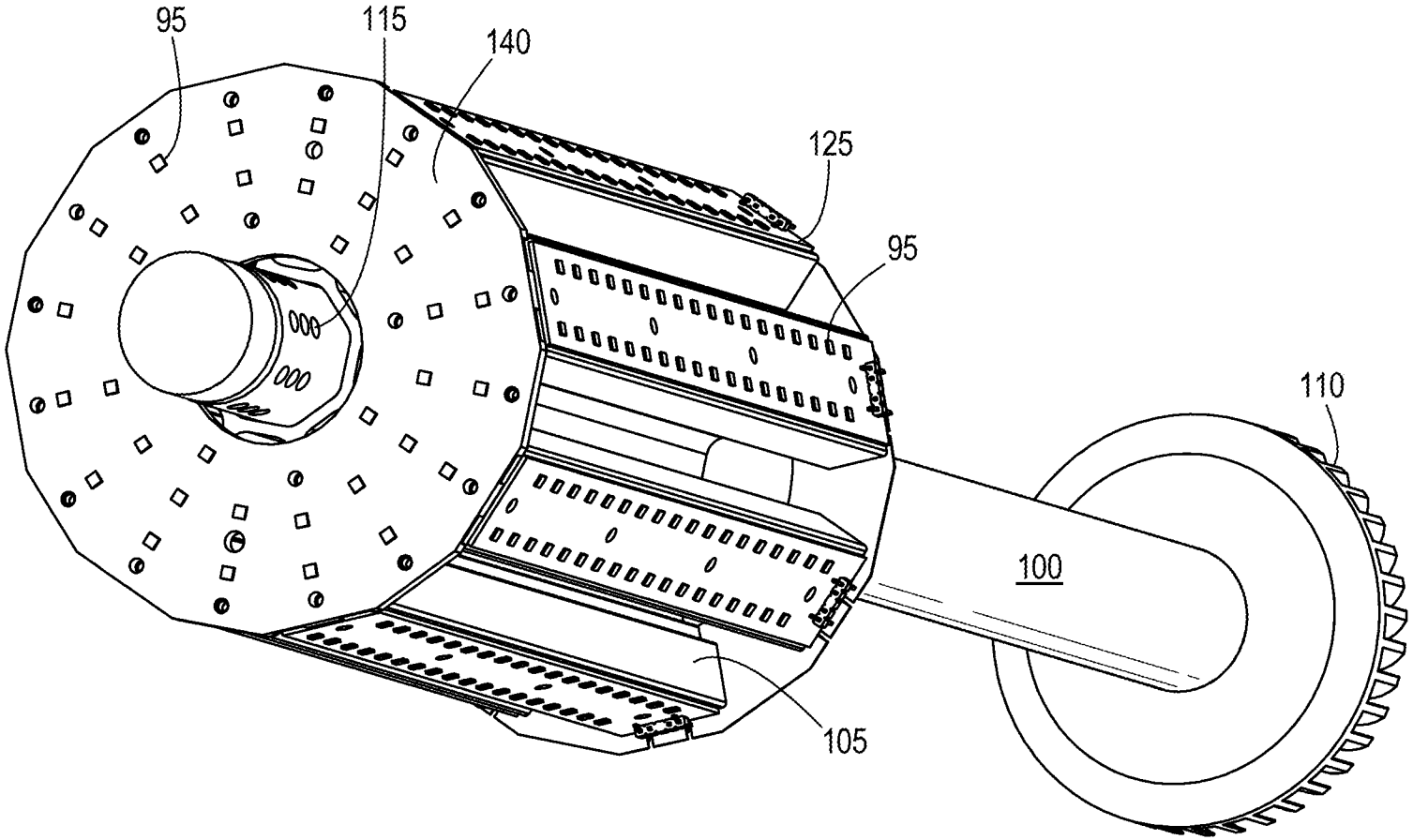
FIG. 10 is a top perspective view of the chimney and light support member of the light of FIG. 1.
Figure 11:
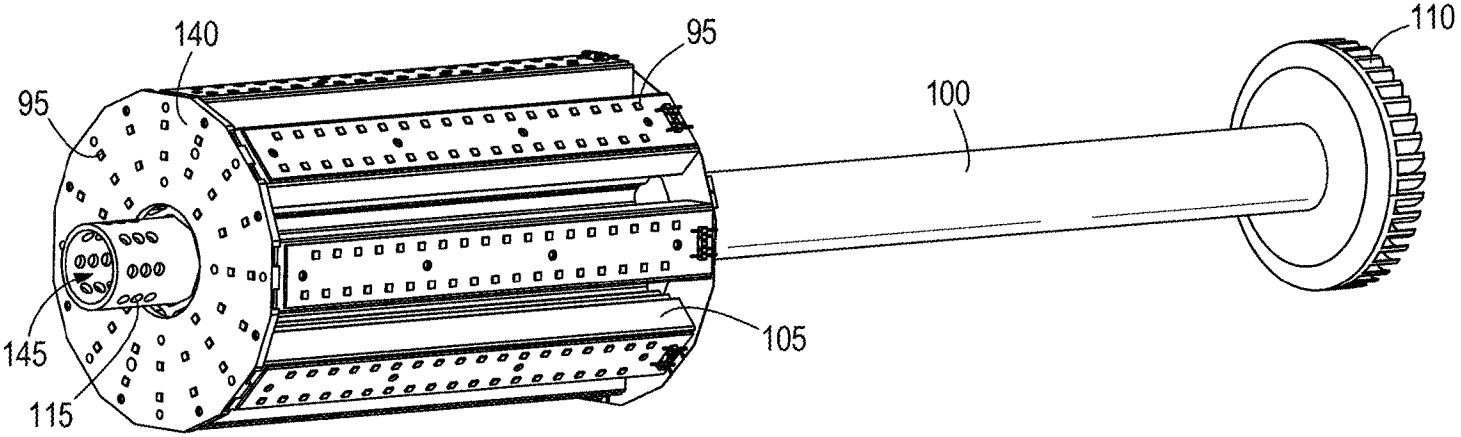
FIG. 11 is a perspective view of the chimney and light support member of the light of FIG. 1.
Figure 12:
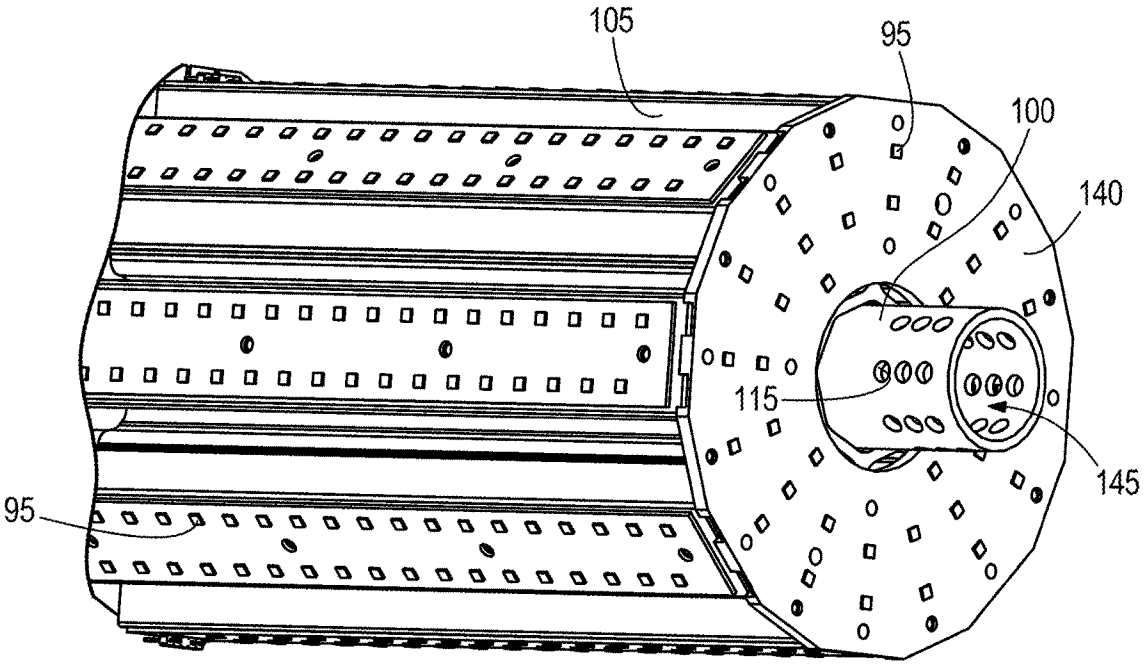
FIG. 12 is an enlarged perspective view of the light support member of the light of FIG. 1.

The light support member 105, illustrated in FIGS. 6 and 10, is formed from a heat conducting material and includes a plurality of LED support surfaces 125. The LEDs 95 are attached to these surfaces 125 and heat generated by the LEDs 95 is conducted into the light supporting member 105. The member 105 includes a plurality of arms 130 that extend outward and support a plurality of fins 135 that increase the surface area and further enhance cooling. In addition, LEDs 95 may be attached to a top support member 140 that attaches to the top of the light supporting member 105 to emit light from the top of the light 10.

Figure 8:
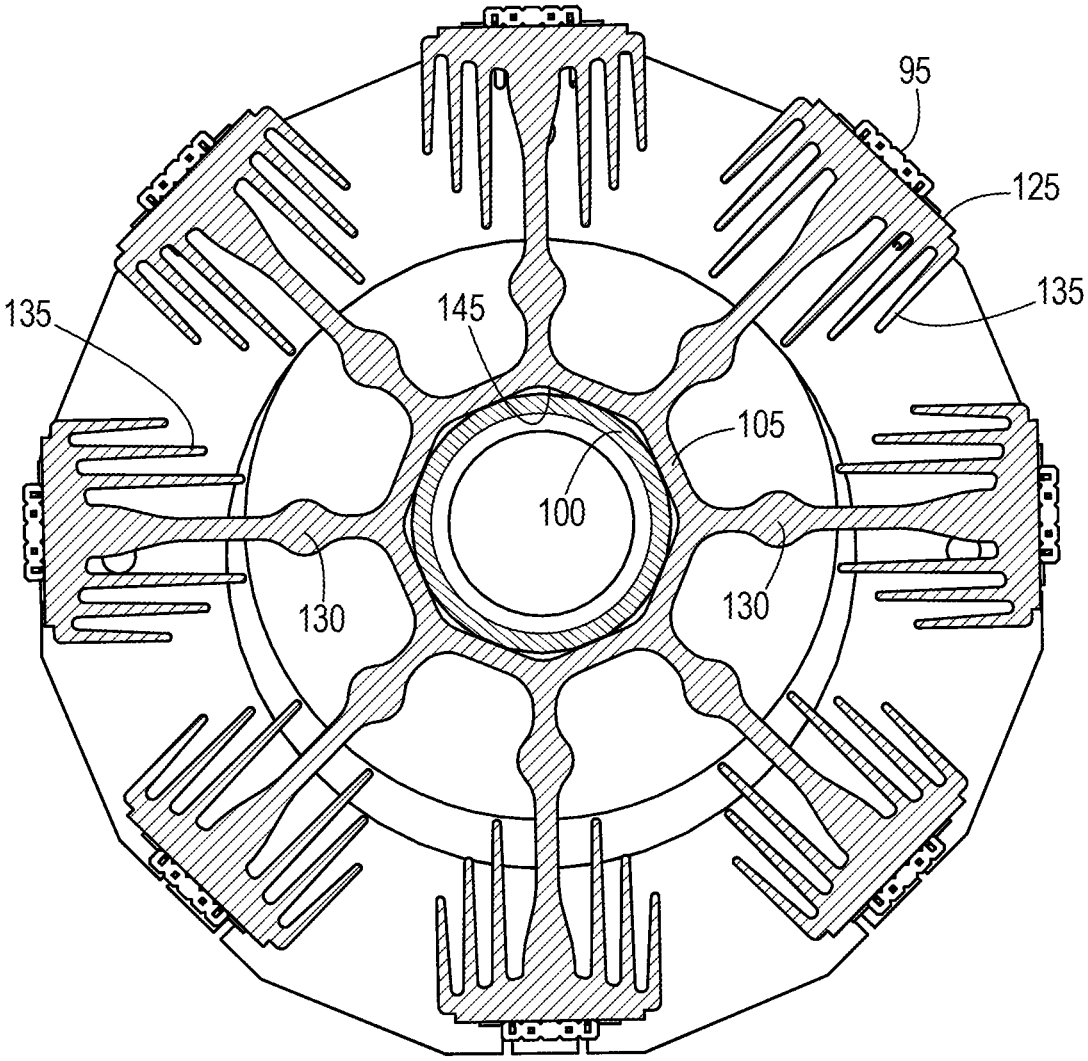
FIG. 8 is a section view of the light support member of FIG. 6.
Figure 9:
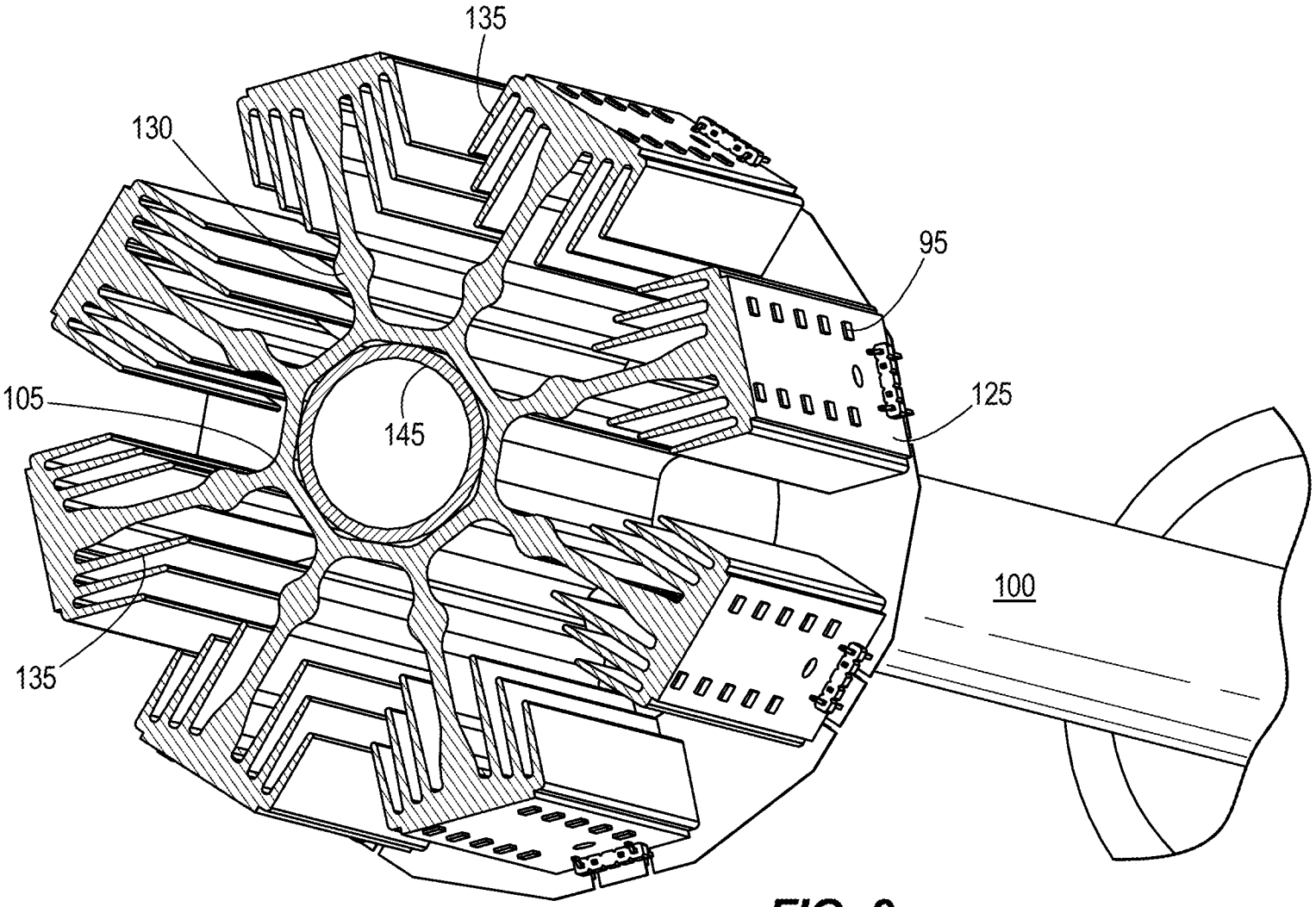
FIG. 9 is a perspective view of the light support member in section as shown in FIG. 8.

As illustrated in FIG. 8, a central aperture 145 formed in the light supporting member 105 receives the chimney 100 and provides thermal conduction therebetween. In the illustrated construction, the central aperture 145 is polygonal with other shapes being possible. In preferred constructions, the circuit boards 90 are also connected, or at least thermally coupled to the chimney 100 to aid in thermal conduction and cooling of the circuit boards 90.

In operation, the LEDs 95 are powered by either the DC power supply or the AC power supply to generate the desired illumination. The circuit boards 90 and the LEDs 95 generate a significant amount of heat during operation. Some of that heat is conducted into the chimney 100 either directly, or through the light supporting member 105. As the chimney 100 heats, a natural convection pattern is established. The hot air within the chimney 100 rises and exits the light 10, thereby drawing additional cool air into the bottom of the light 10. In this manner, the cooling ability of the light 10 is enhanced.

Figure 13:
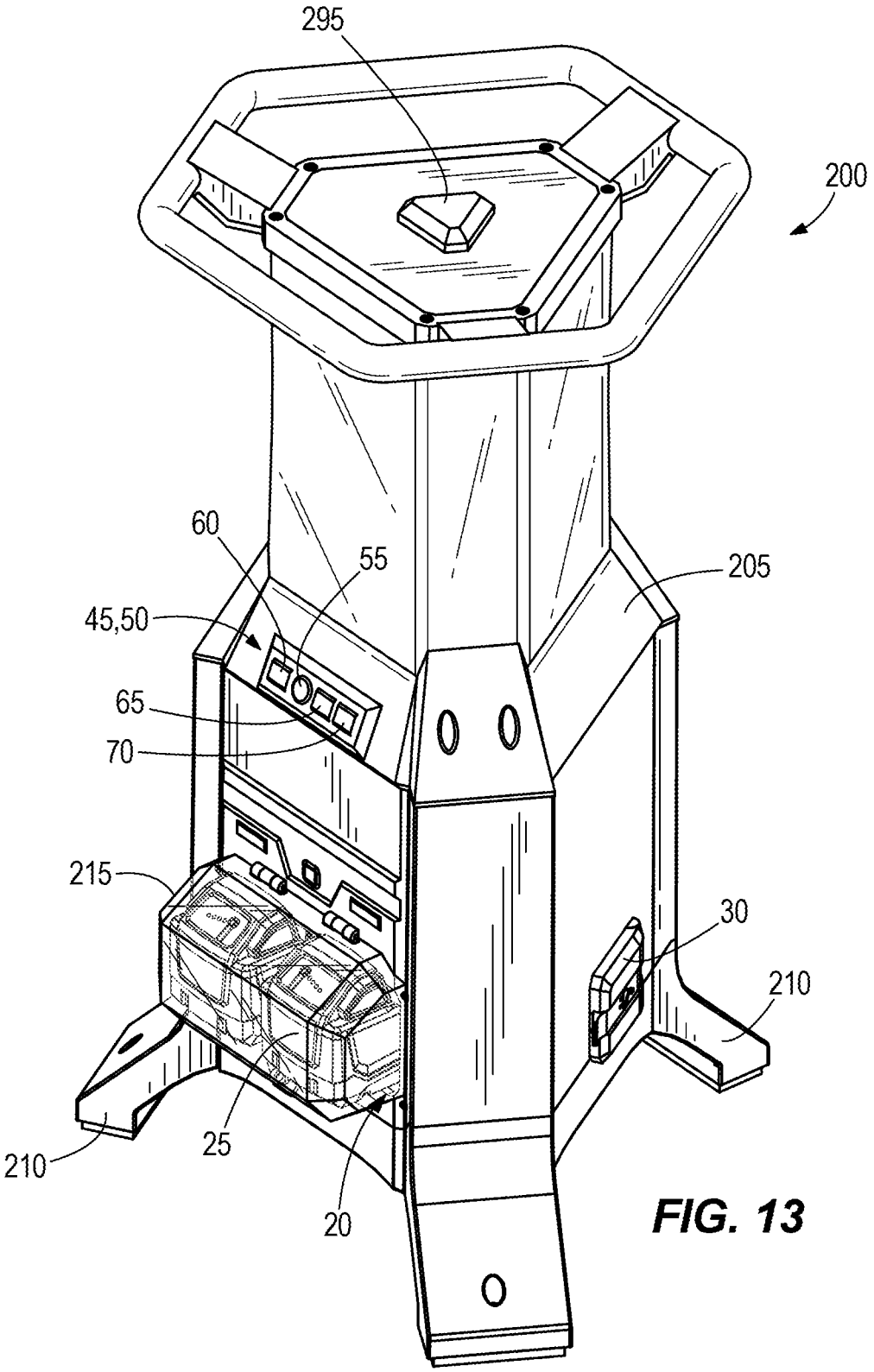
FIG. 13 is a perspective view of another construction of a light.

FIGS. 13-22 illustrate another version of the light 200 of FIGS. 1-12. As illustrated in FIG. 13, the light 200 includes a housing 205 that is similar to that of the light 10 of FIG. 1. However, the light 200 does not include an external handle but rather includes a plurality of legs 210 that provide support for the housing 205 while providing an air space under the housing 205. In addition, a hinged cover 215 is provided that can open to receive or remove one or both of the power tool battery packs 25. In the illustrated construction, the cover 215 is illustrated as transparent. However, opaque and colored covers could also be employed if desired.

Figure 14:
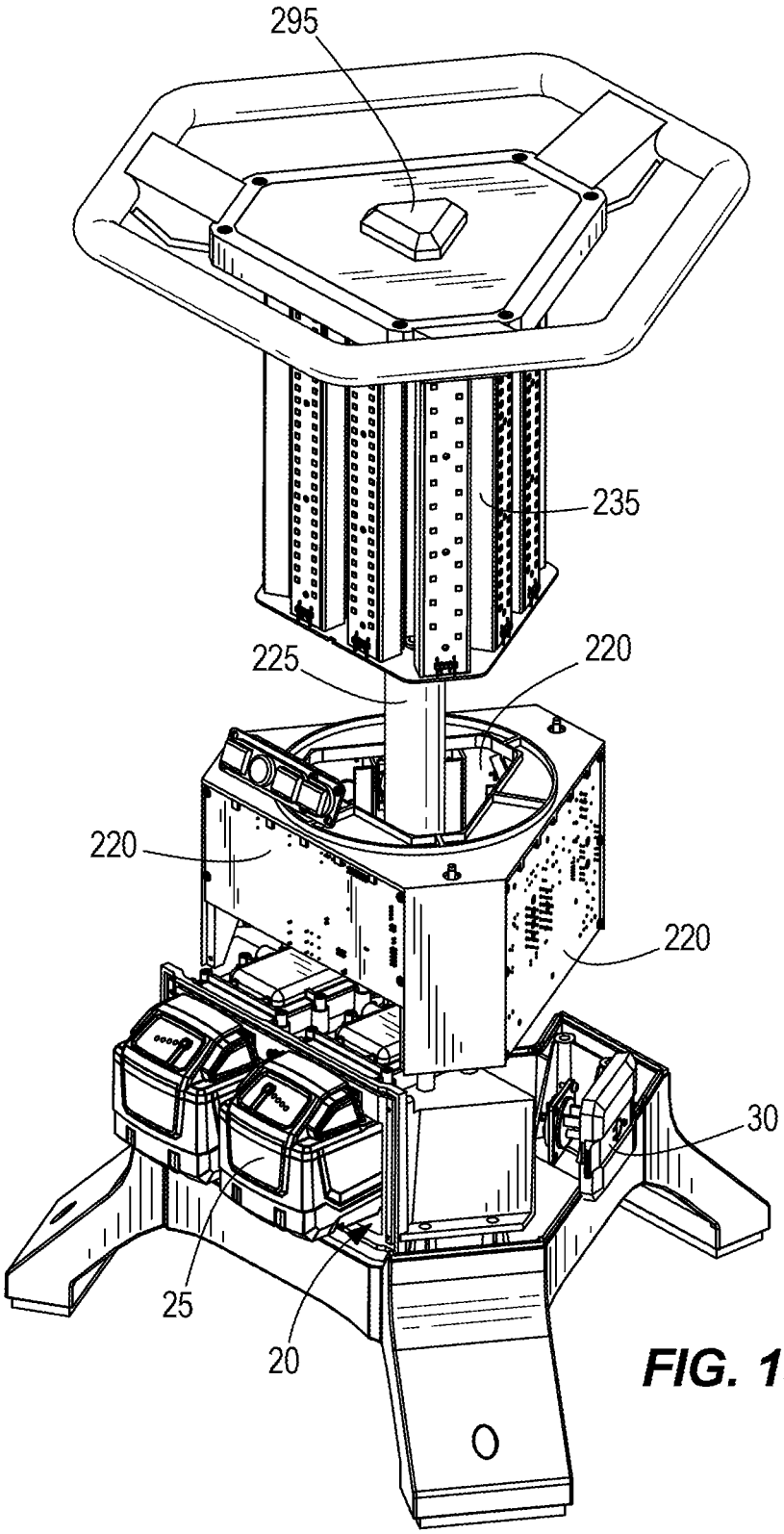
FIG. 14 is a perspective view of the light of FIG. 13 with the external covers removed.
Figure 15:
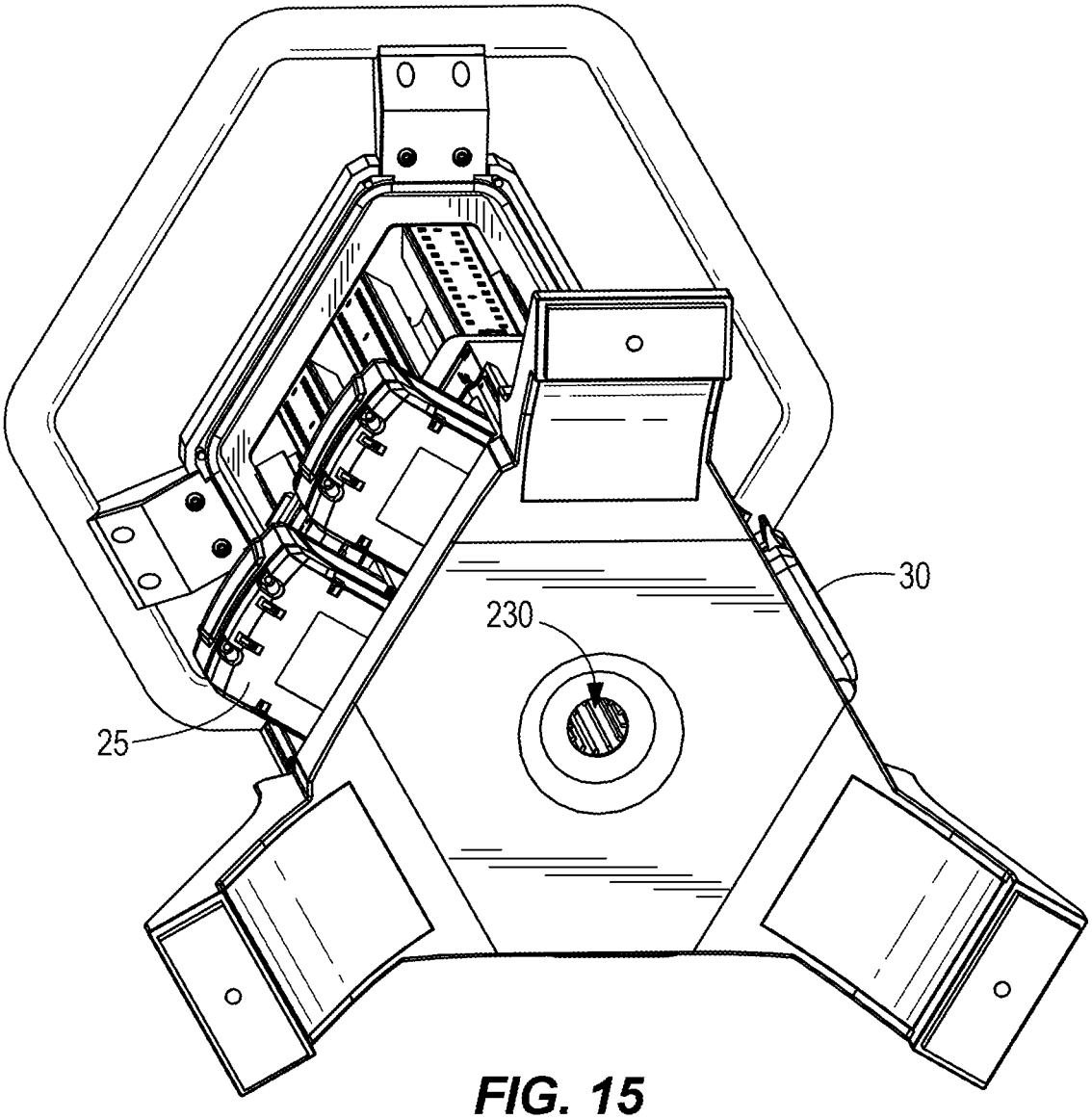
FIG. 15 is a bottom perspective view of the light arranged as shown in FIG. 14.
Figure 16:
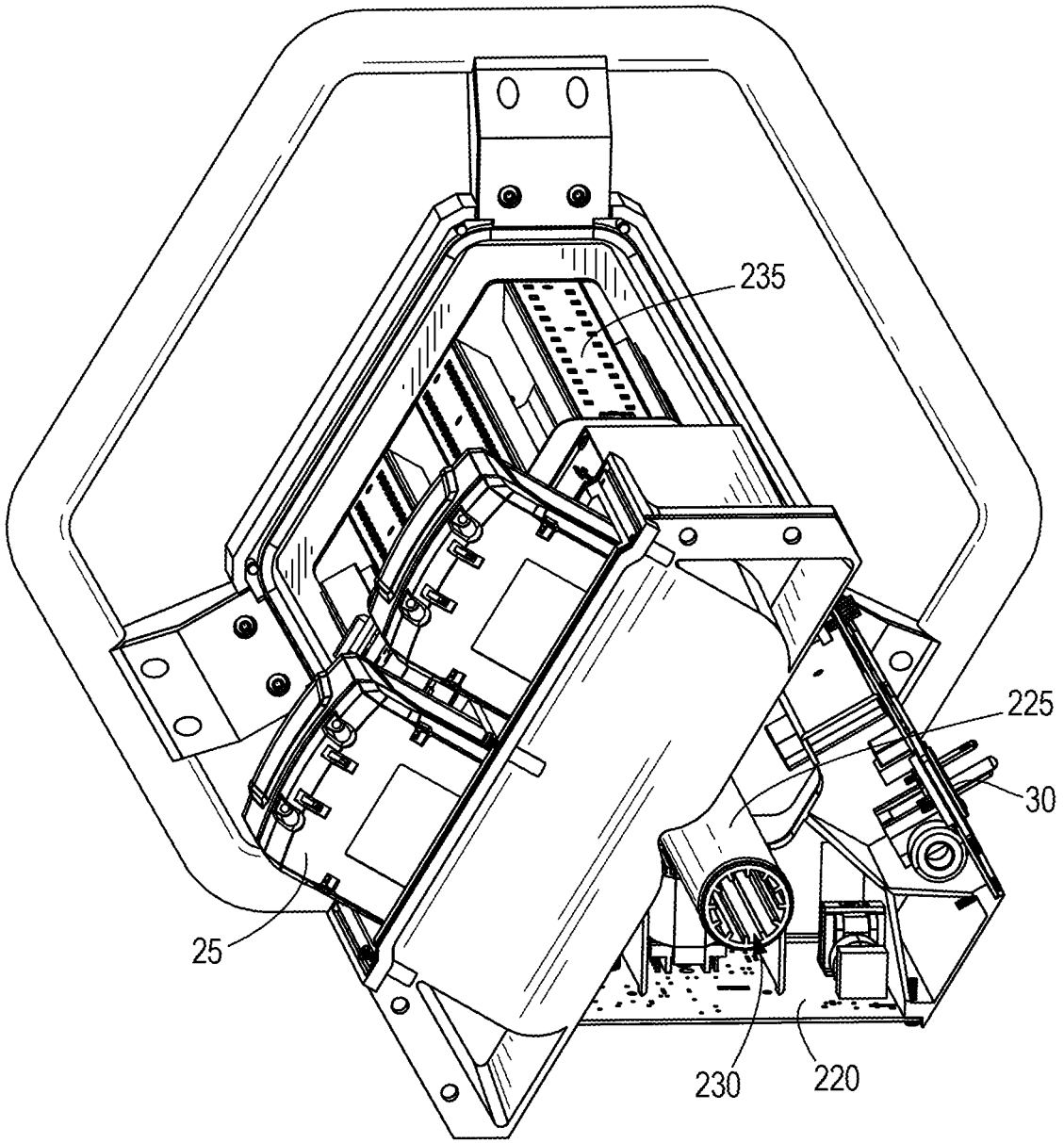
FIG. 16 is an enlarged view of the bottom of the light of FIG. 13.
Figure 17:
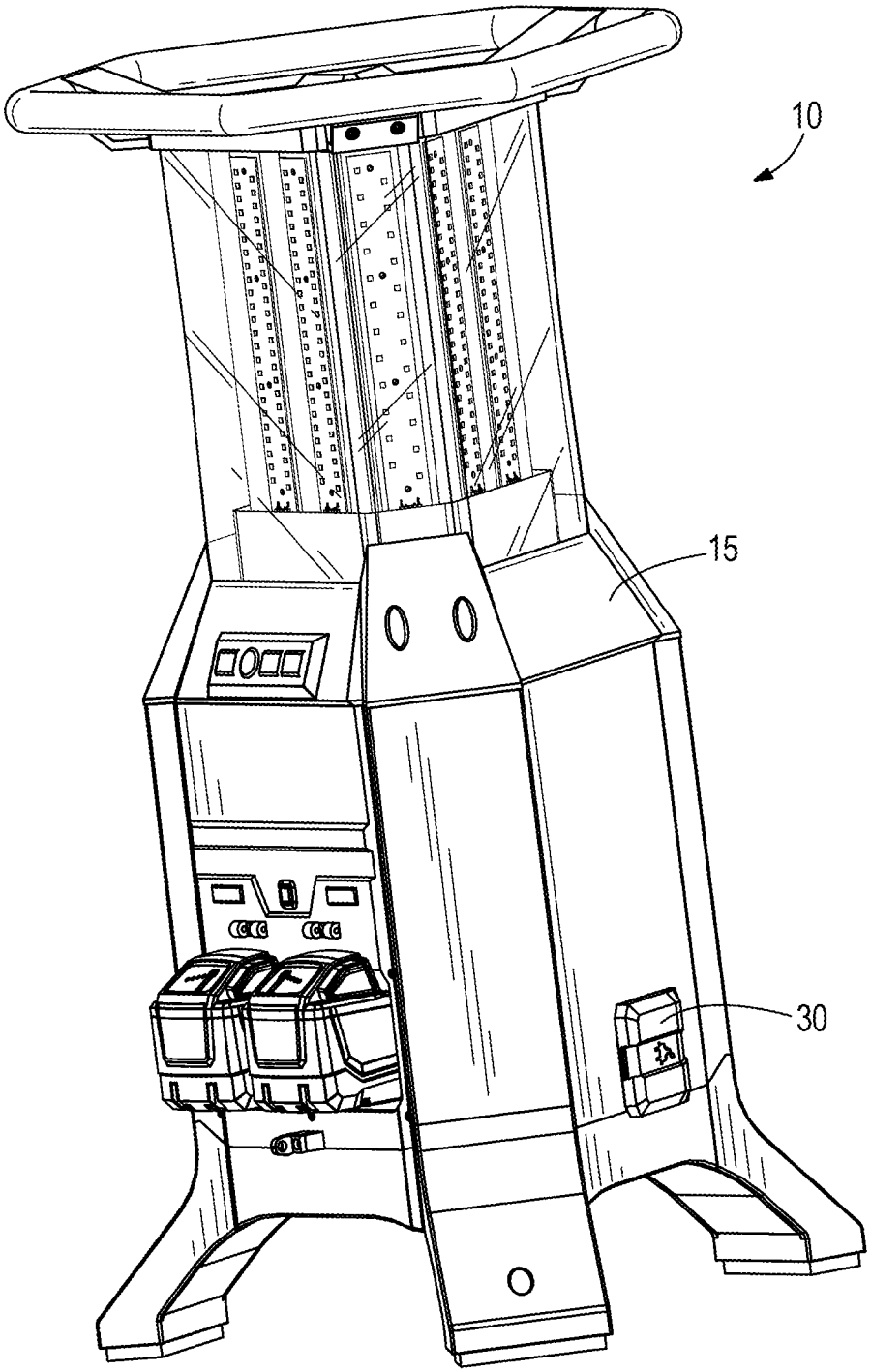
FIG. 17 is a perspective view of the light of FIG. 13.

As illustrated in FIG. 14, circuit boards 220 including the light controls as well as a power control and charging circuits are disposed within the housing 205. In addition, a tube or chimney 225 that at least partially defines a cooling air path 230 extends through the light 200 from the bottom of the housing 205. As shown in FIG. 15, the chimney 225 opens at the bottom of the housing 205 to receive a flow of cooling air. In this arrangement, the legs 210 maintain the position of the opening above the ground to assure that air is free to flow between the legs 210 and into the opening as may be required.

FIGS. 18-22 best illustrate the chimney 225 and a light support member or heat sink 235 of the construction of FIGS. 13-22. As can be seen, the shape and arrangement of these features is different than those of the construction of FIGS. 1-12.

The light support member or heat sink 235 includes a plurality of light support surfaces 240 that are arranged around the perimeter of the light support member 235 and that each support a plurality of LEDs 245 much like the construction of FIGS. 1-12. Specifically, a plurality of circuit boards are attached or bonded to the light support surfaces 240 and are thermally connected to allow the LEDs 245 to emit light outward from the light support member 235 and to allow heat produced by the LEDs 245 to conduct into the light support member 235. The arrangement of the light 200 of FIGS. 13-22 is such that light is emitted in a 360 degree pattern around the light 200. In addition, a flat light support 250 is positioned on top of the light support member 235 and includes a plurality of LEDs 245 arranged to project light upward in a direction substantially parallel to a central axis 255 of the light 200 (i.e., the chimney axis).

Figure 21:
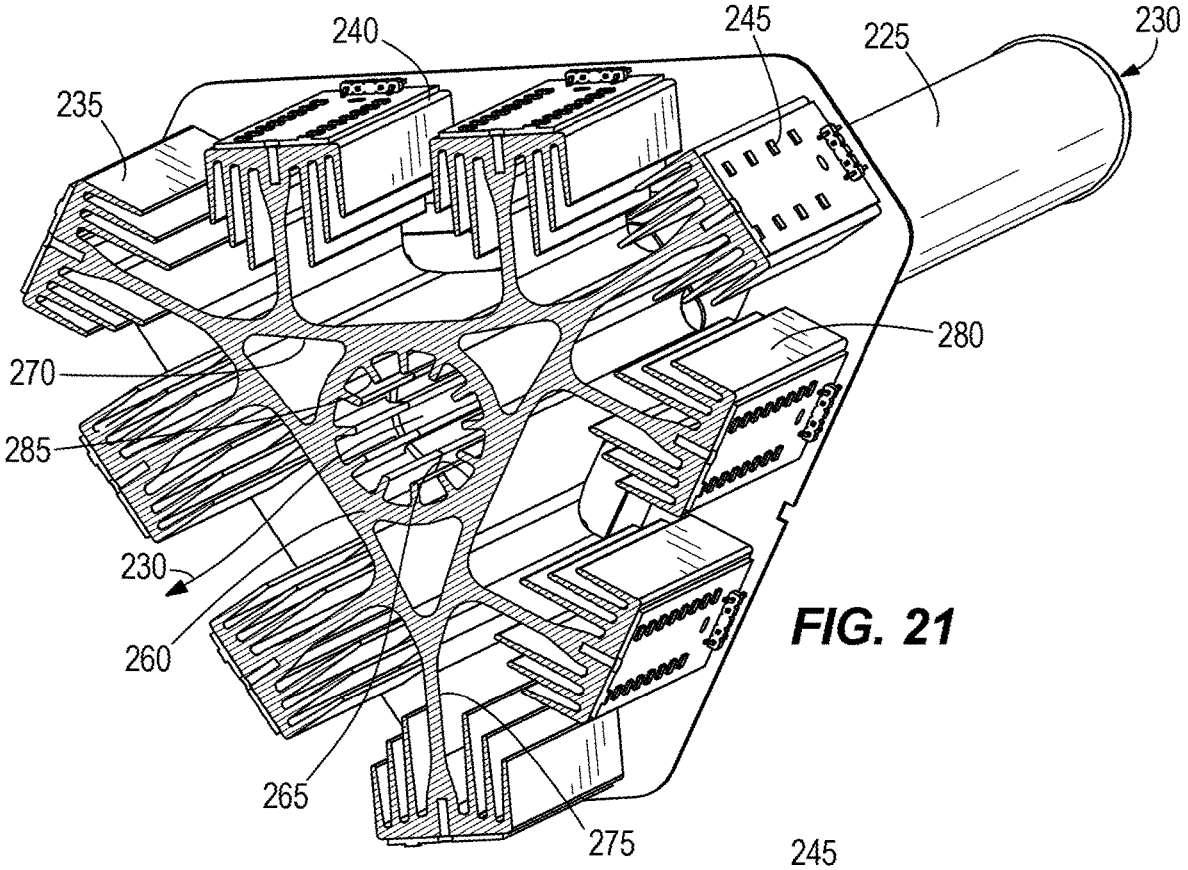
FIG. 21 is a section view of the light support member of FIG. 18 taken along line 21-21 of FIG. 18.
Figure 22:
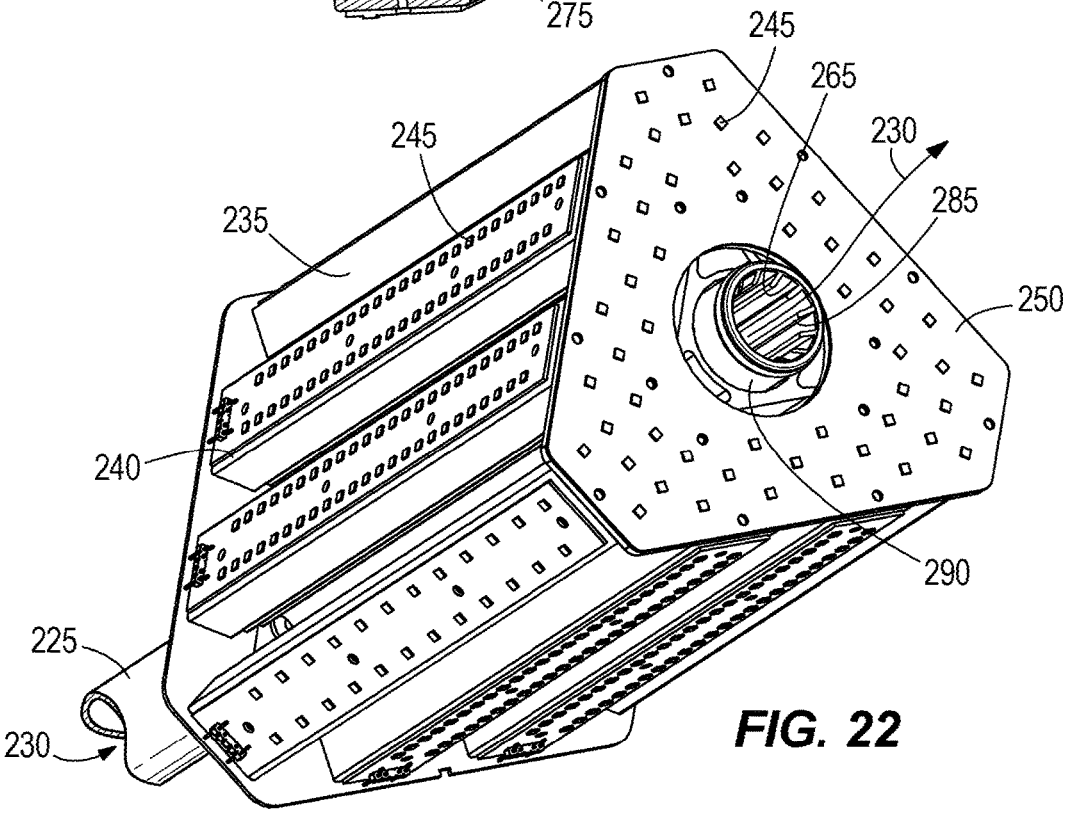
FIG. 22 is a top perspective view of the chimney and light support member of the light of FIG. 13.

With reference to FIG. 21, the light support member or heat sink 235 includes a central body 260 that defines a central aperture 265 and a plurality of external apertures 270. The central aperture 265 and the external apertures 270 extend along parallel offset axes such that they do not intersect and they extend the full length of the heat sink 235. The central body 260 is substantially triangular in cross-section. Each of a plurality of arms 275 extends from the central body 260 and includes one of the light support surfaces 240. In addition, a plurality of fins 280 extends from each of the light support surfaces 240 toward the central body 260 to provide additional surface area for cooling. The triangular shape of the central body 260 provides space for nine arms 275 with two arms 275 extending from each side of the triangular cross section and one arm 275 extending from each vertex. Of course other arrangements of the heat sink 235 are possible.

The central aperture 265 includes a plurality of interior fins 285 that further increase the surface area in the central aperture 265. Additionally, the external apertures 270 provide more surface area that can be utilized to enhance the cooling effect as air passes through the external apertures 270 and the central aperture 265.

While the chimney 100 of the construction of FIGS. 1-12 includes a single tube 100 that extends the full length of the light 10, the construction of FIGS. 13-22 includes a shorter tube 225 that cooperates with the central aperture 145 to complete the cooling flow path 230. The chimney 225, best illustrated in FIG. 19, extends from the bottom of the light 200 to the bottom of the heat sink 235 where it connects to the heat sink 235. In the illustrated construction, the chimney 225 threadably engages the heat sink 235 with other attachment methods also being possible.

Figure 18:
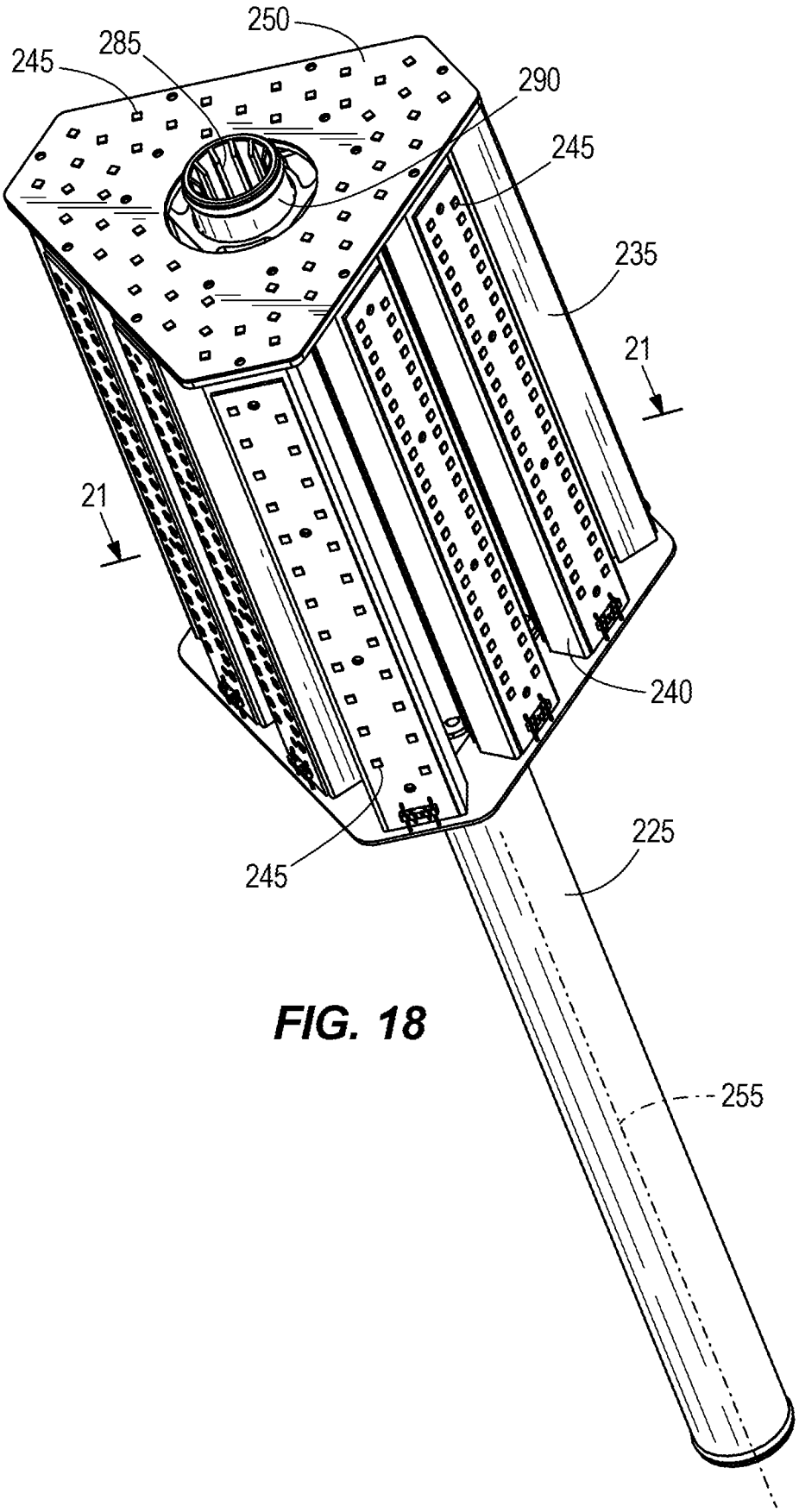
FIG. 18 is a perspective view of a chimney and light support member of the light of FIG. 13.
Figure 19:
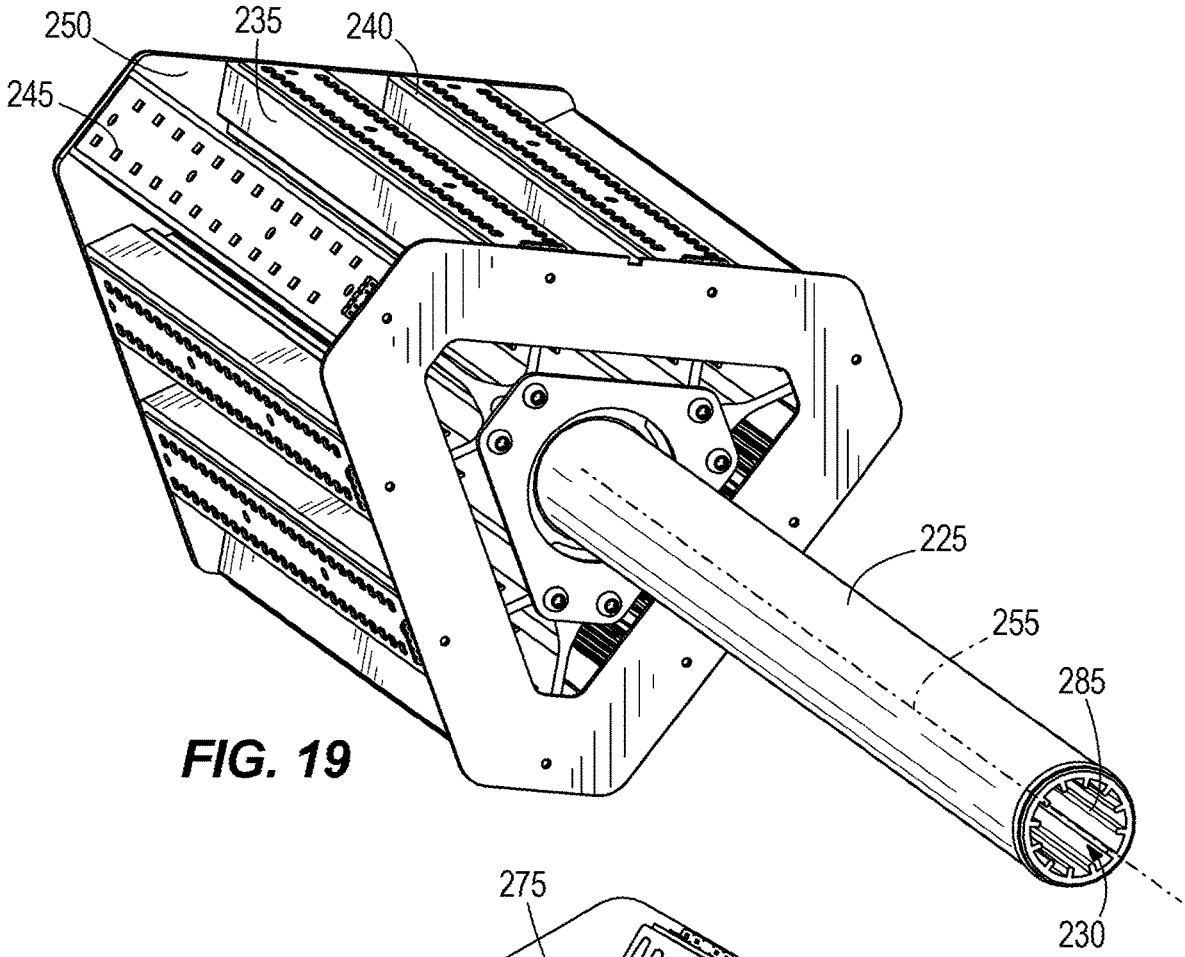
FIG. 19 is a bottom perspective view of the chimney and light support member of the light of FIG. 13.
Figure 20:
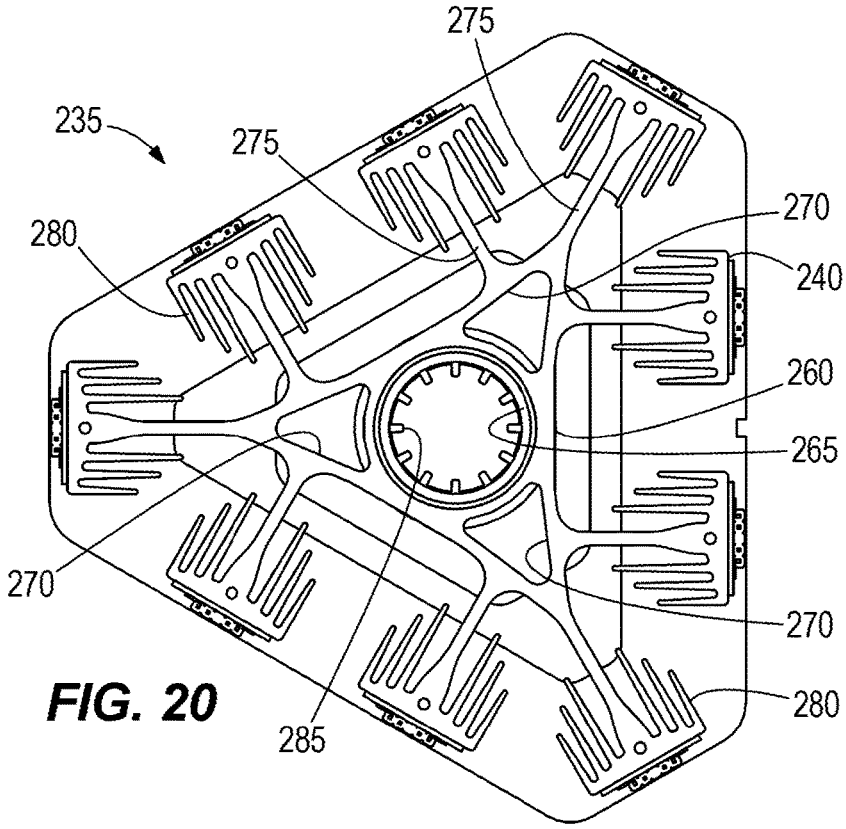
FIG. 20 is a top view of the light support member of FIG. 19.

A shorter tube 290, shown in FIG. 18, is connected to the top of the heat sink 235 to complete the cooling flow path through the light 200. A cap 295 is placed on top of the opened short tube 290 to cover the opening to reduce the likelihood of water entering the cooling flow path 230. As with the larger tube or chimney 225, the short tube 290 threadably engages the heat sink 235. The cap 295 can attach using a simple frictional engagement or can threadably attach to the shorter tube 290 as desired.

In operation, the user uses a power button 55 to actuate the light 200 and select an operating mode. The power control circuit or charging circuit 40 determines where power for the LEDs 245 should come from. First the power control circuit 40 determines if AC power is available from an external source. If AC power is not available, the power control circuit 40 will use the battery packs 25 if they are positioned in the battery pack ports 20. If only one battery pack 25 is present, power will be drawn from that battery pack 25. If two battery packs 25 are present, the power control circuit 40 first determines the state of charge for each of the battery packs 25 and then selects the battery pack 25 with the lowest state of charge to deliver power to the LEDs 245 much like the embodiment of FIGS. 1-12.

As the LEDs 245 operate, they emit light and produce heat. The heat conducts into the heat sink 235 and increases the temperature of the heat sink 235. The higher temperature of the heat sink 235 heats the air within the central aperture 265, the external apertures 270, and the air around the various fins 280. As the air is heated it rises, thereby producing a natural convection current through the heat sink 235. In the natural convection current, cool air enters the cooling flow path through the bottom opening in the tube or chimney 225. The air rises through the tube 225, through the central aperture 265, into the short tube 290 and out the top of the light 200 to complete the cooling flow path. Similarly, air flows through the external apertures 270 and the various fins 280 from the bottom of the heat sink 235 to the top of the heat sink 235 to enhance the cooling ability of the heat sink 235.

It should be noted that any feature described with regard to one construction is equally applicable to any of the other constructions described herein.

Various features and advantages of the invention are set forth in the following claims.

What is claimed is:

1. A light comprising:

a housing including an upper portion, a lower portion, and a battery port formed in the lower portion;

a heat sink extending upward from the lower portion of the housing and positioned within the upper portion of the housing;

a plurality of LEDs coupled to the heat sink, the plurality of LEDs configured to emit light through the upper portion of the housing;

a power input supported on the lower portion of the housing, the power input configured to connect to an external AC power source to power the plurality of LEDs;

a battery pack received in the battery port to power the plurality of LEDs; and a control panel supported by the lower portion of the housing, the control panel including a power control and an intensity control, the intensity control operable to change intensities of the plurality of LEDs;

wherein the light is operable in a first configuration of intensity settings when the AC power source is powering the plurality of LEDs, and the light is operable in a second configuration of intensity settings when the battery pack is powering the plurality of LEDs, and wherein the first configuration includes more intensity settings than the second configuration.

2. The light of claim 1, wherein the first configuration includes six intensity settings, and wherein the second configuration includes three intensity settings.

3. The light of claim 1, wherein the control panel further includes a light intensity indicator.

4. The light of claim 1, wherein the control panel further includes an indicator operable to indicate when the light is using DC power from the battery pack and when the light is using AC power from the external AC power source.

5. The light of claim 1, further comprising a charging circuit positioned within the housing and electrically coupled to the power input, the charging circuit operable to charge the battery pack.

6. The light of claim 1, further comprising a power outlet supported on the lower portion of the housing, the power outlet configured to connect to another device to power the another device.

7. The light of claim 1, wherein operation of the plurality of LEDs is remotely controlled using a wireless communication scheme.

* * * * *